US011433406B2

(12) United States Patent
Lin et al.

(10) Patent No.: US 11,433,406 B2
(45) Date of Patent: Sep. 6, 2022

(54) WATERWAY SWITCHING MECHANISM AND METHOD FOR SWITCHING THE WATERWAY SWITCHING MECHANISM

(71) Applicant: Xiamen Solex High-Tech Industries Co., Ltd., Xiamen (CN)

(72) Inventors: Fengde Lin, Xiamen (CN); Wenxing Chen, Xiamen (CN); Donghai Chen, Xiamen (CN); Bin Cao, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 258 days.

(21) Appl. No.: 16/870,854

(22) Filed: May 8, 2020

(65) Prior Publication Data

US 2020/0353486 A1 Nov. 12, 2020

(30) Foreign Application Priority Data

May 8, 2019 (CN) ..... 201910379860.3
Nov. 25, 2019 (CN) ..... 201911167484.8

(51) Int. Cl.

| | |
|---|---|
| ***B05B 1/18*** | (2006.01) |
| ***B05B 1/16*** | (2006.01) |
| ***B05B 1/30*** | (2006.01) |
| ***E03C 1/04*** | (2006.01) |

(52) U.S. Cl.

CPC ..... *B05B 1/18* (2013.01); *B05B 1/1654* (2013.01); *B05B 1/1681* (2013.01); *B05B 1/3086* (2013.01); *E03C 1/0404* (2013.01)

(58) Field of Classification Search

CPC ..... B05B 1/18; B05B 1/1654; B05B 1/1681; B05B 1/3086; E03C 1/0404

See application file for complete search history.

(56) References Cited

U.S. PATENT DOCUMENTS

| | | | | |
|---|---|---|---|---|
| 6,059,200 | A * | 5/2000 | Chou | B05B 1/3006 239/126 |
| 9,512,602 | B2 * | 12/2016 | Lei | E03C 1/08 |
| 10,480,164 | B2 * | 11/2019 | Hu | E03C 1/0409 |
| 2018/0243764 | A1 * | 8/2018 | Lin | B05B 1/169 |

FOREIGN PATENT DOCUMENTS

| | | |
|---|---|---|
| CN | 202427568 U | 9/2012 |
| CN | 206082884 U | 4/2017 |

* cited by examiner

*Primary Examiner* — Steven M Cernoch

(74) *Attorney, Agent, or Firm* — Cooper Legal Group, LLC

(57) ABSTRACT

The present disclosure discloses a waterway switching mechanism comprising a mounting portion, a water dividing plate, and a driving mechanism. The mounting portion comprises at least one water dividing passage, and the water dividing plate cooperates with the at least one water dividing passage to switch a waterway through rotation of the water dividing plate. A third upper guiding surface of the movable block contacts and couples to a first inner guiding surface of the water dividing plate to enable the movable block to move to drive the water dividing plate to rotate in a first direction. The movable block cooperates with a fixing guiding surface of an upper matching portion of the mounting portion to enable the push rod to move to drive the movable block and the water dividing plate to rotate in the first direction.

11 Claims, 23 Drawing Sheets

WATERWAY SWITCHING MECHANISM AND METHOD FOR SWITCHING THE WATERWAY SWITCHING MECHANISM

RELATED APPLICATIONS

This application claims priority to Chinese Patent Application 201910379860.3, filed on May 8, 2019, and Chinese Patent Application 201911167484.8, filed on Nov. 25, 2019. Chinese Patent Application 201910379860.3 and Chinese Patent Application 201911167484.8 are incorporated herein by reference.

FIELD OF THE DISCLOSURE

The present disclosure relates to the field of sanitary ware, and in particular to a waterway switching mechanism and a switching method thereof.

BACKGROUND OF THE DISCLOSURE

There are many ways to switch waterways in sanitary ware. The common two methods are the sliding switching method and the rotating switching method. The sliding switching method refers to controlling the water outflow of different waterways by relative sliding. The rotating switching method refers to controlling the water outflow of different waterways by relative rotation. The structure of a waterway switching mechanism used for the rotating switching method comprises a mounting portion, a water dividing plate, and a driving mechanism. The mounting portion is provided with a plurality of water dividing passages, and the water dividing plate is installed in the mounting portion and cooperates with the water dividing passages to switch the waterway by rotation of the water dividing plate. The driving mechanism drives the water dividing plate to rotate. There are two conventional types of driving mechanisms.

In the first type, a knob is provided. The knob and the water dividing plate are coaxially fixed, and rotation of the knob drives the water dividing plate to achieve switching. The structure is complicated, the occupied space is large, and the switching resistance is large, resulting in inconvenient switching.

In the second type, a button is provided. In a shower switching structure with a button, such as described in CN202427568U, the shower switching structure comprises a button, a water dividing plate, a ratchet shaft, a spring, and a plurality of inclined guide columns. The button can be pushed in and out along an axial direction of the button. The outer end of the button is formed as a pressing end, and the inner end is provided with a plurality of protrusions. The water dividing plate is coaxially arranged with the button. The water dividing plate is limited with respect to movement in an axial direction of the water dividing plate, but it can freely rotate. A through hole for connecting a main inflow passage and an inflow water dividing passage is disposed in the water dividing plate. The ratchet shaft rotates synchronously with the water dividing plate and can freely slide along an axis thereof in the water dividing plate. The ratchet shaft connects with a ratchet wheel on a side facing the protrusions of the button. The ratchet wheel has a plurality of inclined guiding surfaces that can abut the protrusions. The spring abuts the ratchet shaft and generates a force for moving the ratchet shaft toward the button. The inclined guide columns are provided with guide grooves for guiding the button, and the inclined guide columns respectively abut one of the inclined guiding surfaces and rotate the ratchet shaft when the ratchet shaft rebounds due to an elastic force of the spring. In the shower switching structure, when the button is pushed, the water dividing plate can be moved and rotated to realize the switching of the water spray pattern. Since the water dividing plate has to be raised, a water dividing body and a gasket must adopt a secondary filling process, resulting in increases in production cost and in rejection rate due to defects.

BRIEF SUMMARY OF THE DISCLOSURE

The present disclosure provides a waterway switching mechanism to solve deficiencies of the existing techniques.

In order to solve the aforementioned technical problems, a first technical solution of the present disclosure is as follows.

A waterway switching mechanism comprises a mounting portion, a water dividing plate, and a driving mechanism. The mounting portion comprises at least one water dividing passage. The water dividing plate is disposed in the mounting portion and cooperates with the at least one water dividing passage to switch a waterway through rotation of the water dividing plate. The mounting portion further comprises an upper matching portion and a lower matching portion, and the upper matching portion comprises a fixing guiding surface. The water dividing plate comprises a first through passage, and the first through passage comprises a first inner guiding surface. the driving mechanism comprises a push rod, a movable block, and an elastic body, the push rod is slidably connected to the lower matching portion, the push rod comprises a first upper guiding surface, the movable block comprises a lower guiding surface and a third upper guiding surface, and the elastic body is connected to the driving mechanism and the mounting portion to drive the driving mechanism to be reset. The first upper guiding surface of the push rod contacts and couples to the lower guiding surface of the movable block to enable the push rod to move to drive the movable block to move, and the third upper guiding surface of the movable block contacts and couples to the first inner guiding surface of the water dividing plate to enable the movable block to move to drive the water dividing plate to rotate in a first direction. The movable block cooperates with the fixing guiding surface of the upper matching portion to enable the push rod to move to drive the movable block and the water dividing plate to rotate in the first direction.

In a preferred embodiment, the movable block further comprises a fourth upper guiding surface, a guiding direction of the third upper guiding surface is opposite to a guiding direction of the fourth upper guiding surface, and the fourth upper guiding surface cooperates with the fixing guiding surface.

In a preferred embodiment, an upper side of the third upper guiding surface is connected to an upper side of the fourth upper guiding surface.

In a preferred embodiment, the push rod further comprises a second upper guiding surface, and a guiding direction of the first upper guiding surface is opposite to a guiding direction of the second upper guiding surface.

In a preferred embodiment, an upper side of the first upper guiding surface is connected to an upper side of the second upper guiding surface.

In a preferred embodiment, the mounting portion further comprises a water dividing chamber, the lower matching portion comprises a second through passage connected to the water dividing chamber, and the push rod is slidably connected to the second through passage.

In a preferred embodiment, an inner wall of the second through passage comprises a guide groove extending inward, an outer periphery of the push rod comprises a guide protrusion extending outward, the guide protrusion couples to the guide groove to enable the push rod to be slidably connected to the second through passage. The inner wall of the second through passage further comprises one or more first inner convex portions extending outward, top portions of the one or more first inner convex portions comprise a second inner guiding surface. The outer periphery of the push rod further comprises a first outer convex portion, the first outer convex portion is disposed between two adjacent first inner convex portions of the one or more first inner convex portions, and the first outer convex portion comprises the first upper guiding surface and the second upper guiding surface.

In a preferred embodiment, the movable block further comprises a body and a second outer convex portion extending outward from the body, an upper portion of the second outer convex portion comprises a convex structure, a top portion of the second outer convex portion comprises the third upper guiding surface and the fourth upper guiding surface, and a bottom surface of the second outer convex portion comprises the lower guiding surface.

In a preferred embodiment, the upper matching portion further comprises a limiting portion, and the second outer convex portion abuts the limiting portion to achieve positioning.

In a preferred embodiment, the upper matching portion further comprises a plurality of matching protrusions annularly arranged, each of the plurality of matching protrusions comprises two side walls oppositely disposed, a first side wall of the two side walls comprises the fixing guiding surface, and a second side wall of the two side walls comprises the limiting portion.

In a preferred embodiment, the push rod further comprises a rotation limiting groove, the movable block further comprises a rotation limiting protrusion, the rotation limiting protrusion cooperates with the rotation limiting groove to prevent the movable block from rotating in a second direction, and the second direction is opposite to the first direction.

In a preferred embodiment, the rotation limiting protrusion is disposed on the lower guiding surface of the movable block.

In a preferred embodiment, the waterway switching mechanism further comprises a button. A first end of the button is swingably connected to the lower matching portion, and the button abuts a lower end of the push rod.

In a preferred embodiment, the waterway switching mechanism further comprises a central shaft. An upper end of the central shaft is fixedly connected to the upper matching portion, the push rod is slidably connected to the central shaft, and the movable block is rotatably and slidably connected to the central shaft. The elastic body surrounds the central shaft and is disposed between the upper matching portion and the movable block.

In a preferred embodiment, the fixing guiding surface, the first inner guiding surface, the lower guiding surface, and the third upper guiding surface are spiral surfaces or inclined surfaces.

In a preferred embodiment, the waterway switching mechanism further comprises a first button configured to move relative to the mounting portion, the first button is operatively connected to a lower end of the push rod.

In a preferred embodiment, the at least one water dividing passage comprises a water inlet passage, the water dividing plate is a driven plate, the driven plate is disposed on the water inlet passage and is configured to rotate relative to the mounting portion, and the driven plate rotates to control the water inlet passage to be closed and to be open.

In a preferred embodiment, the driven plate further comprises a side wall, the first through passage is disposed in the side wall, and an end surface of the side wall comprises a water groove passing through the side wall. The driven plate is configured to rotate between a closed position and an open position. When the driven plate is disposed in the open position, the water groove defines a part of the water inlet passage. When the driven plate is disposed in the closed position, a side wall of the water groove contacts the water inlet passage to close the water inlet passage.

In a preferred embodiment, a bottom wall of the water inlet passage comprises a mounting groove, the lower matching portion is disposed in the mounting groove, a bottom of the mounting groove comprises a connection groove connected to an outer side of the mounting portion, and a tail end of the push rod is slidably and hermetically sealed to the connection groove to enable the push rod to extend out from the mounting portion. A top side of the water inlet passage comprises a through groove passing through the water inlet passage, the upper matching portion is disposed in the through groove, and the driven plate is disposed between the mounting groove and the through groove.

In a preferred embodiment, the waterway switching mechanism further comprises a second water dividing plate, a second button movably connected to the mounting portion and a ratchet wheel-ratchet intermittent movement mechanism, the ratchet wheel-ratchet intermittent movement mechanism is operatively connected between the second button and the second water dividing plate, the mounting portion further comprises a second plurality of water dividing passages and a water dividing chamber connected to the water inlet passage, the second water dividing plate is rotatably connected to the mounting portion, and the second water dividing plate rotates to control the second plurality of water dividing passages to be switched to be connected to the water dividing chamber.

In a preferred embodiment, the waterway switching mechanism further comprises a second water dividing plate, a first button movably connected to the mounting portion, a second button movably connected to the mounting portion, and a ratchet wheel-ratchet intermittent movement mechanism. The first button is fixedly connected to a lower end of the push rod, the ratchet wheel-ratchet intermittent movement mechanism is operatively connected between the second button and the second water dividing plate, the mounting portion further comprises a second plurality of water dividing passages and a water dividing chamber connected to the water inlet passage, the second water dividing plate is rotatably connected to the mounting portion, the second water dividing plate rotates to control the second plurality of water dividing passages to be switched to be connected to the water dividing chamber, and the first button and the second button are arranged in a line.

In a preferred embodiment, the at least one water dividing passage comprises a plurality of water dividing passages, and the water dividing plate is disposed in the mounting portion and cooperates with the plurality of water dividing passages to switch the plurality of water dividing passages through the rotation of the water dividing plate.

A second technical solution of the present disclosure is as follows.

A waterway switching mechanism, comprises a mounting portion, a water dividing plate, and a driving mechanism. The mounting portion comprises at least one water dividing passage, and the water dividing plate is only rotatably disposed in the mounting portion and cooperates with the at least one water dividing passage to drive the water dividing plate to rotate to switch waterways. The driving mechanism comprises a push rod, a movable block, and an elastic body. The push rod is slidably connected to the mounting portion, the push rod slidably pushes the movable block to move. A movement of the movable block comprises a first process and a second process. When the movable block is in the first process, the movable block slides and pushes the water dividing plate to rotate in a first direction. When the movable block is in the second process, the movable block at least rotates in the first direction and drives the water dividing plate to rotate in the first direction to drive the water dividing plate to complete switching. The elastic body stores energy due to movement of the movable block in the first process and the second process and is driven by the stored energy to drive the driving mechanism to be reset.

In a preferred embodiment, the at least one water dividing passage comprises a plurality of water dividing passages, and the water dividing plate is only rotatably disposed in the mounting portion and cooperates with the plurality of water dividing passages to drive the water dividing plate to rotate to switch waterways.

A third technical solution of the present disclosure is as follows.

A method for switching a waterway switching mechanism, the method comprises following steps: pushing a push rod to drive a movable block to move relative to a mounting portion, the movable block sliding and pushing a water dividing plate to rotate relative to the mounting portion in a first direction; continuing to push the push rod to drive the movable block to move relative to the mounting portion, the movable block sliding and rotating in the first direction, wherein a rotation of the movable block in the first direction drives the water dividing plate to continue to rotate relative to the mounting portion in the first direction to achieve a first switching; and releasing the push rod, wherein an elastic body that stored energy while pushing the push rod and continuing to push the push rod drives the push rod and the movable block to be reset.

Compared with existing techniques, the technical solution provided by the present disclosure has the following advantages.

The water dividing plate only realizes the rotation function (no movement function), which can reduce the cost, reduce the occupied space, and result in a compact structure. The first upper guiding surface of the push rod and the lower guiding surface of the movable block can be in contact engagement with each other to move the movable block by the movement of the push rod. The third upper guiding surface of the movable block and the first inner guiding surface of the water dividing plate can be in contact with each other to drive the water dividing plate to rotate in the first direction by the movement of the movable block. The movable block and the fixing guiding surface of the upper matching portion cooperate to enable the movable block and the water dividing plate to rotate together in the first direction by the movement of the push rod. The pressing force is small, and therefore the product is easy to press and easy to switch.

The mounting portion is provided with a water dividing chamber, and the lower matching portion is provided with a second through passage connected to the water dividing chamber. The push rod is slidably connected to the second through passage. The structure is simple, and the mounting is convenient.

The guide protrusion is adapted to the guide groove so that the push rod can be slidably connected to the second through passage, and the structure is simple and compact.

The first outer guiding surface and the second upper guiding surface are disposed on the first outer convex portion for convenient cooperation.

The present disclosure further comprises a button. One end of the button is swingably connected to the lower matching portion, and the button also abuts the lower end of the push rod for convenient operation.

The present disclosure further comprises a central shaft. The upper end of the central shaft is fixedly coupled with the upper matching portion, and the push rod is slidably coupled to the central shaft. The movable block is rotatably and slidably coupled to the central shaft. The elastic body is sleeved on the central shaft and is disposed between the upper matching portion and the movable block. The structure is easy to assemble and the switching stability is improved.

BRIEF DESCRIPTION OF THE DRAWING

The present disclosure will be further described below with the combination of the accompanying drawings and the embodiments.

DETAILED DESCRIPTION OF THE EMBODIMENTS

Embodiment 1

Figure 1:
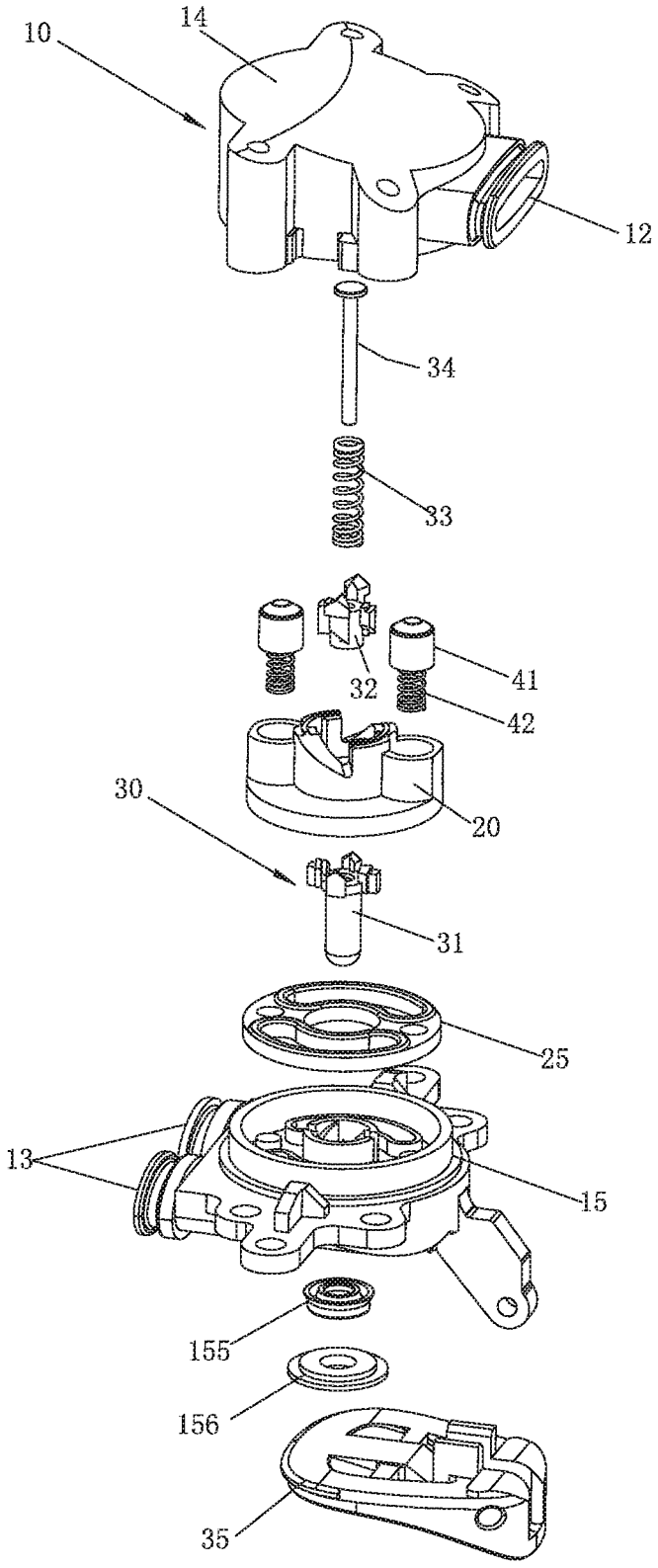
FIG. 1 illustrates an exploded perspective view of a waterway switching mechanism of Embodiment 1.

Referring to FIGS. 1-11, a waterway switching mechanism comprises a mounting portion 10, a water dividing plate 20, and a driving mechanism 30. The driving mechanism 30 comprises a push rod 31, a movable block 32, an elastic body 33, a central shaft 34, and a button 35.

Figure 12:
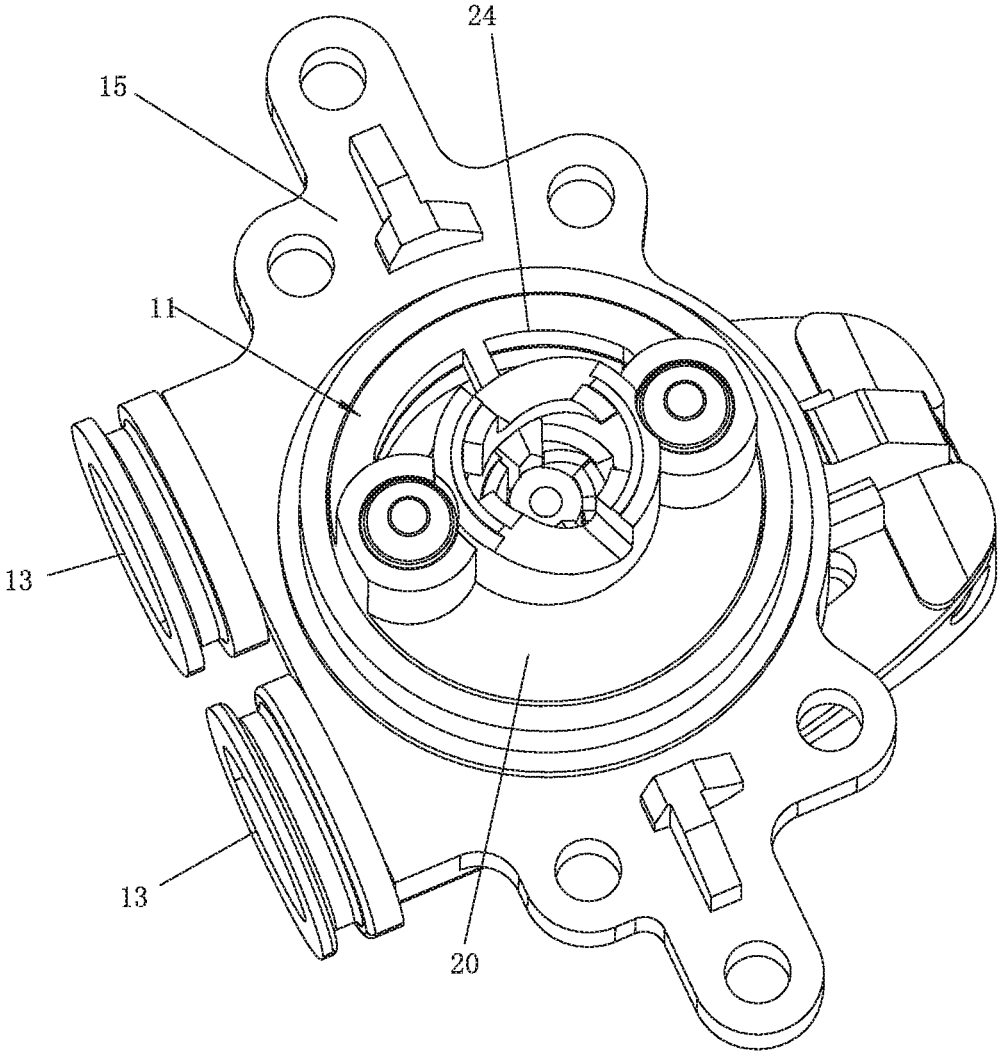
FIG. 12 illustrates a first schematic view of a cooperation of the water dividing body and the water dividing plate of Embodiment 1.
Figure 13:
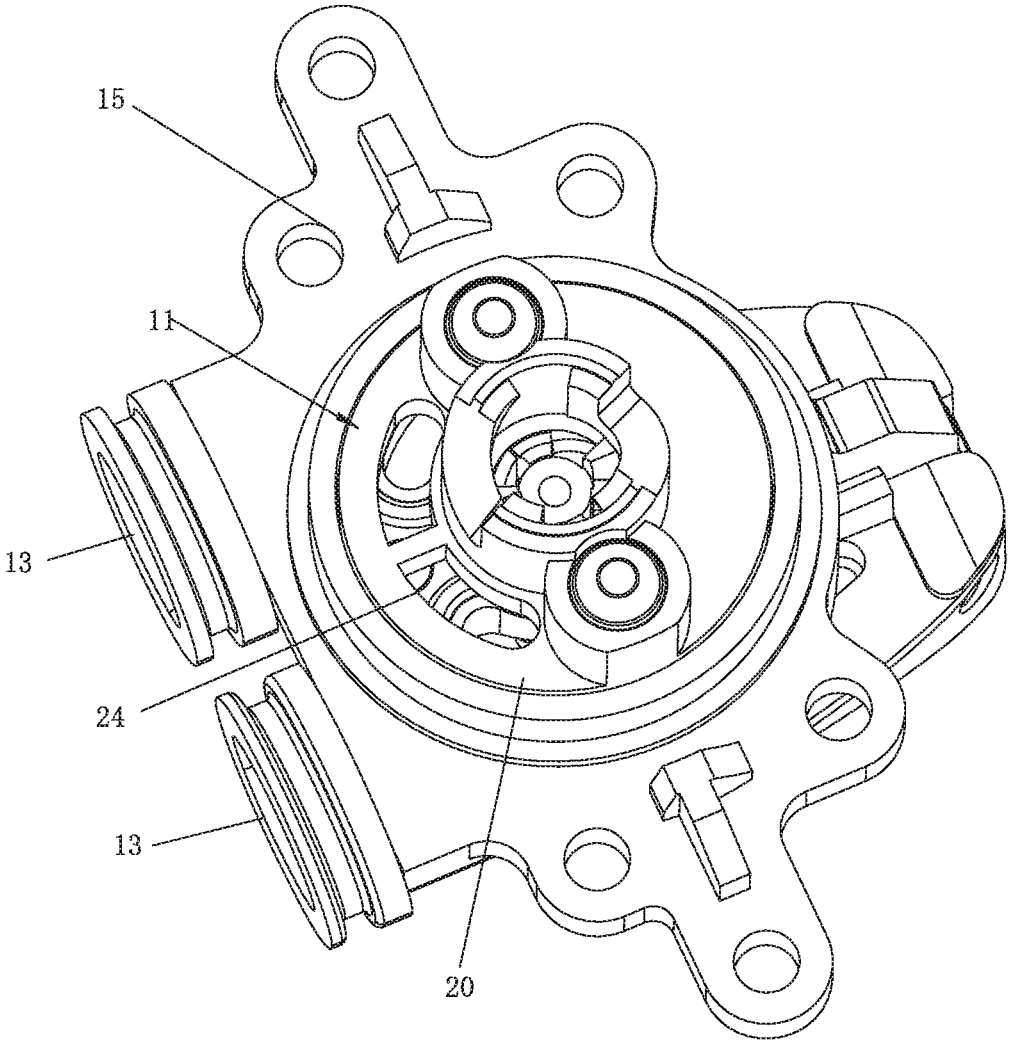
FIG. 13 illustrates a second schematic view of the cooperation of the water dividing body and the water dividing plate of Embodiment 1.
Figure 14:
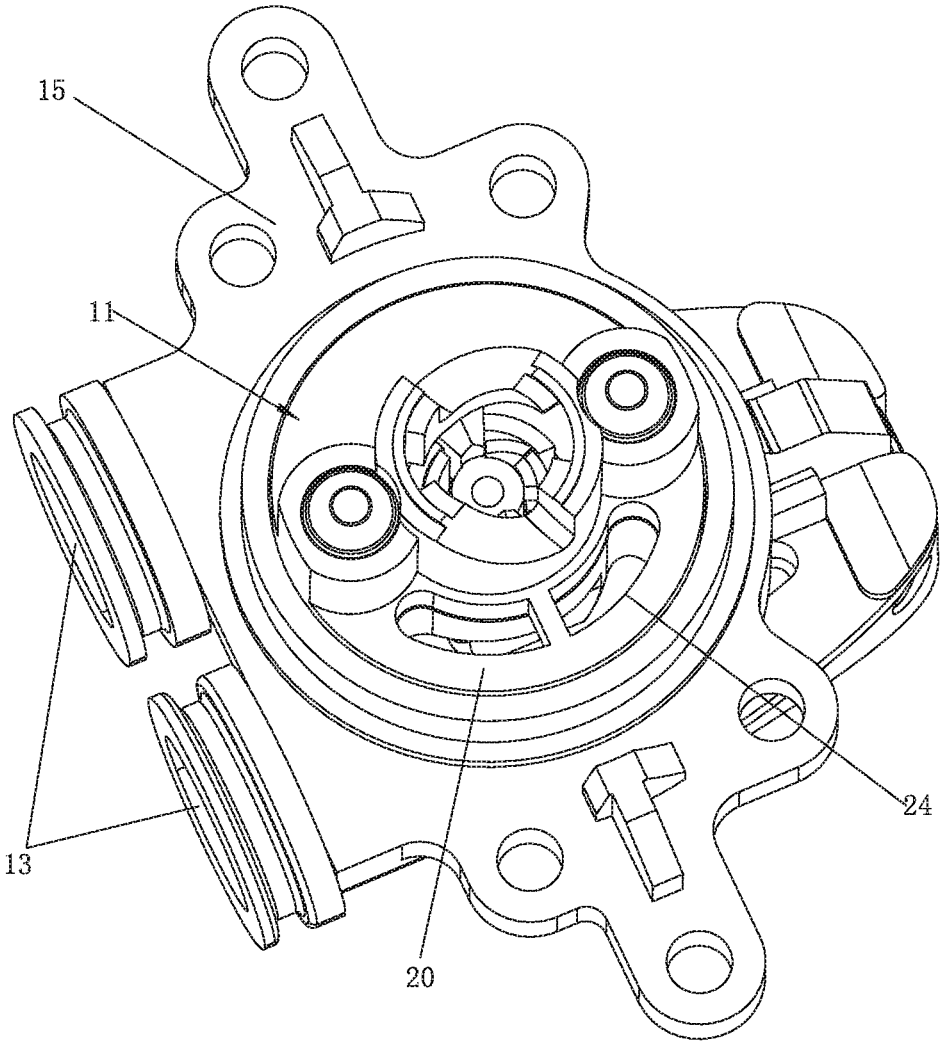
FIG. 14 illustrates a third schematic view of the cooperation of the water dividing body and the water dividing plate of Embodiment 1.

The mounting portion 10 comprises a water dividing chamber 11, a water inlet passage 12 configured to supply water to the water dividing chamber 11, and a plurality of water dividing passages 13. The water inlet passage 12 is connected to the water dividing chamber 11. In the example embodiment, the plurality of water dividing passages 13 comprises two water dividing passages 13, but the number of water dividing passages is not limited thereto. The plurality of water dividing passages 13 can comprise three, four, or more than four water dividing passages 13 when needed. The water dividing plate 20 is rotatably disposed in the water dividing chamber 11 of the mounting portion 10 and cooperates with the two water dividing passages 13, and the water dividing plate 20 is rotated to switch waterways. In a specific embodiment, the water dividing chamber 11 comprises a bottom surface, each of the two water dividing passages 13 comprises a water dividing hole 131 disposed on the bottom surface, and the water dividing plate 20 is rotatably and hermetically sealed to the bottom surface. The water dividing plate 20 comprises a water hole 24, and rotation of the water dividing plate 20 is configured to control the water hole 24 to selectively communicate with at least one of the water dividing holes 131. This means that the at least one of the water dividing holes 131 in communication with the water hole 24 is connected to the water dividing chamber 11 (e.g., water flows out from a corresponding one of the two water dividing passages 13 corresponding to the at least one of the water dividing holes 131 in communication with the water hole 24). The aforementioned method is configured to control one water dividing passage 13 of the plurality of water dividing passages 13 to be connected to the water dividing chamber 11 or to control multiple water dividing passages 13 of the plurality of water dividing passages 13 to be simultaneously connected to the water dividing chamber 11, as shown in FIGS. 12-14. Referring to FIG. 12, the water hole 24 is connected to a first water dividing hole 131 of a first water dividing passage 13 of the two water dividing passages 13, and water flows out from the first water dividing passage 13 corresponding to the first water dividing hole 131. Referring to FIG. 13, the water hole 24 is simultaneously connected to the first water dividing hole 131 and a second water dividing hole 131 of a second water dividing passage 13 of the two water dividing passages 13, and the water simultaneously flows out from the first water dividing passage 13 and the second water dividing passage 13. Referring to FIG. 14, the water hole 24 is connected to the second water dividing hole 131, and the water flows out from the second water dividing passage 13 corresponding to the second water dividing hole 131. In a specific embodiment, the driving mechanism 30 drives the water dividing plate 20 to only rotate in a first direction with respect to the mounting portion 10 and to achieve switching by continuous rotation of the water dividing plate 20. As an example, rotation in the first direction is a counterclockwise rotation. The mounting portion 10 comprises a fixing base 14 and a water dividing body 15. The fixing base 14 and the water dividing body 15 are hermetically sealed together, and the water dividing chamber 11 is defined between the fixing base 14 and the water dividing body 15. The water dividing body 15 comprises the plurality of water dividing passages 13, and the fixing base 14 comprises the water inlet passage 12. The fixing base 14 comprises an upper matching portion 14', and the water dividing body 15 comprises a lower matching portion 15'.

Figure 6:
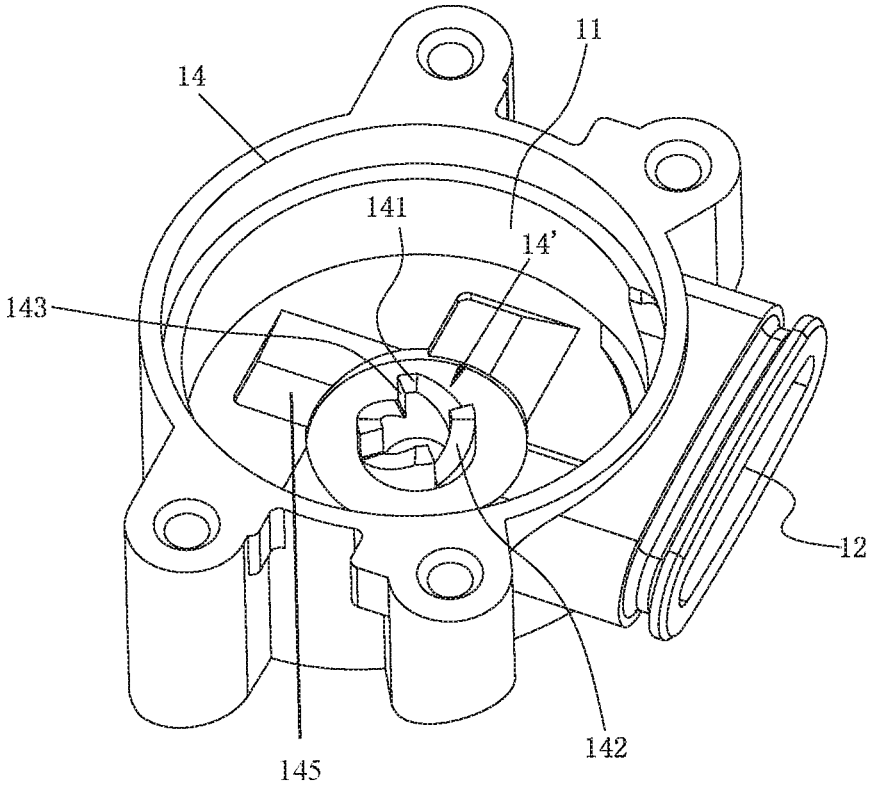
FIG. 6 illustrates a perspective view of a fixing base of Embodiment 1.

Referring to FIG. 6, the upper matching portion 14' comprises a plurality of matching protrusions 141, and the plurality of matching protrusions 141 are fixedly and annularly arranged on a bottom surface of the fixing base 14 (e.g., a top wall of the water dividing chamber 11). Each of the plurality of matching protrusions 141 comprises two side walls oppositely disposed. A first side wall of the two side walls defines a fixing guiding surface 142, and the fixing guiding surface 142 comprises a spiral surface or an inclined surface. A second side wall of the two side walls comprises a limiting portion 143, and for example, the limiting portion 143 comprises a vertical wall.

Figure 7:
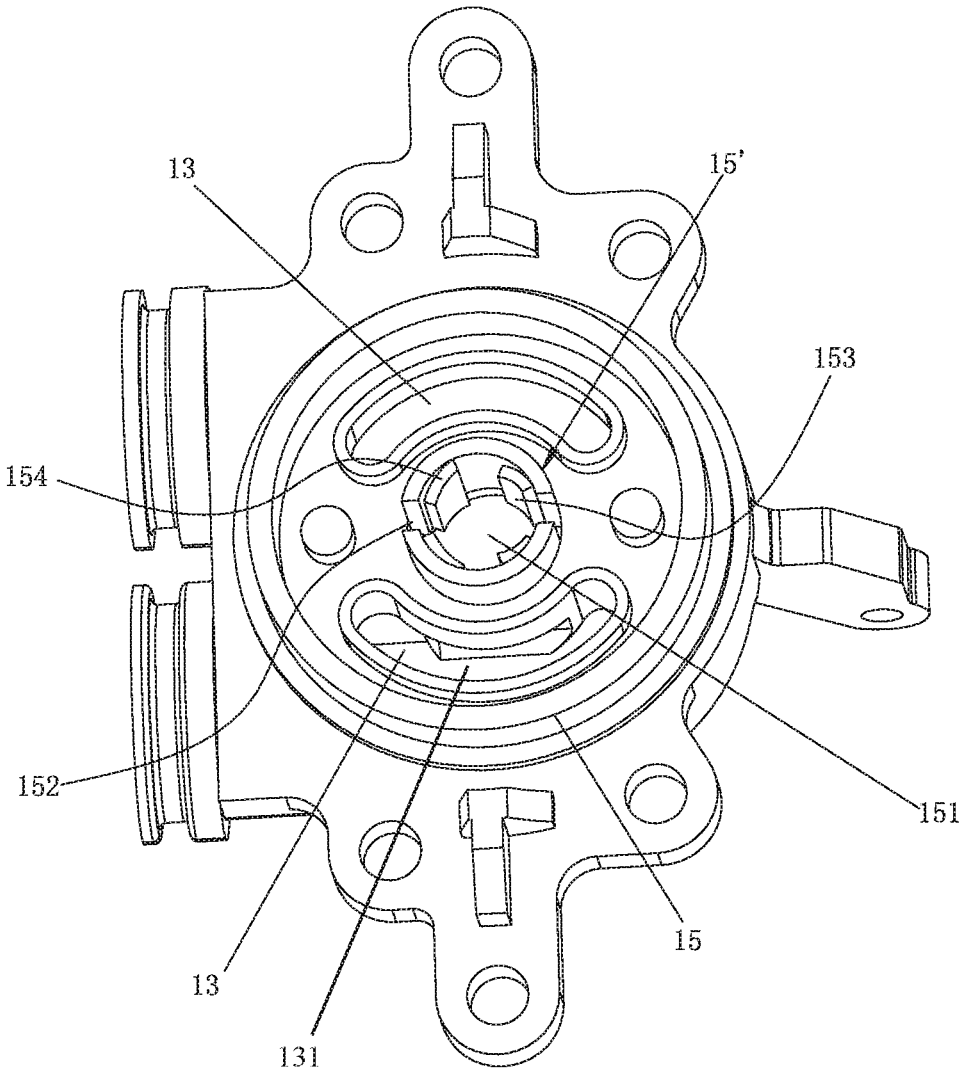
FIG. 7 illustrates a perspective view of a water dividing body of Embodiment 1.
Figure 8:
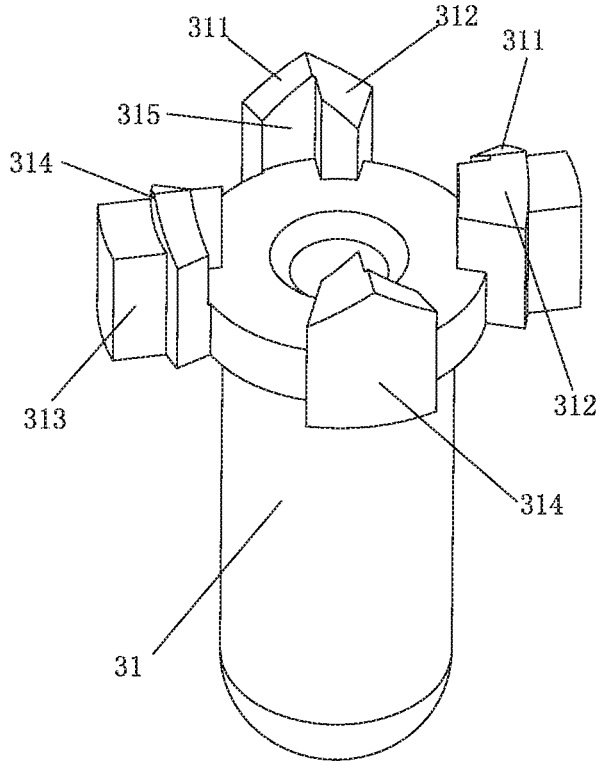
FIG. 8 illustrates a perspective view of a push rod of Embodiment 1.

Referring to FIG. 7, the lower matching portion 15' comprises a second through passage 151 connected to the water dividing chamber 11. The second through passage 151 passes through the water dividing body 15 in a vertical direction. An inner wall of the second through passage 151 comprises two guide grooves 152 extending inward and a plurality of first inner convex portions 153 extending outward from the inner wall of the second through passage 151. The two guide grooves 152 are radially symmetrically disposed, and the plurality of first inner convex portions 153 are annularly disposed at intervals. Top surfaces of the plurality of first inner convex portions 153 define second inner guiding surfaces 154, and the second inner guiding surfaces 154 comprise spiral surfaces or inclined surfaces.

Referring to FIGS. 1-5 and 8, the push rod 31 is slidably connected to the second through passage 151 of the water dividing body 15. The push rod 31 comprises a first upper guiding surface 311 facing upward and a second upper guiding surface 312 facing upward. As an example, the first upper guiding surface 311 and the second upper guiding surface 312 are both spiral surfaces or inclined surfaces, and a guiding direction of the first upper guiding surface 311 and a guiding direction of the second upper guiding surface 312 are opposite. The guiding direction of the first upper guiding surface 311 and the guiding direction of the second upper guiding surface 312 can refer to a spiral direction of the spiral surfaces. An upper side of the first upper guiding surface 311 and an upper side of the second upper guiding surface 312 are connected together. In this embodiment, an outer periphery of the push rod 31 comprises two guide protrusions 313 extending outward. The two guide protrusions 313 are radially symmetrically disposed, and the two guide protrusions 313 couple to the two guide grooves 152 of the second through passages 151 of the water dividing body 15 to enable the push rod 31 to be slidably connected to the second through passage 151. The outer periphery of the push rod 31 further comprises a first outer convex portion 314 extending outward. The first outer convex portion 314 is disposed between two adjacent first inner convex portions 153 of the plurality of first inner convex portions 153. The first upper guiding surface 311 and the second upper guiding surface 312 are disposed on the first outer convex portion 314. In some embodiments, the outer periphery of the push rod 31 comprises four first outer convex portions 314 annually disposed at intervals, and the two guide protrusions 313 respectively extend outward from outer walls of two first outer convex portions 314 of the four first outer convex portions 314.

Figure 10:
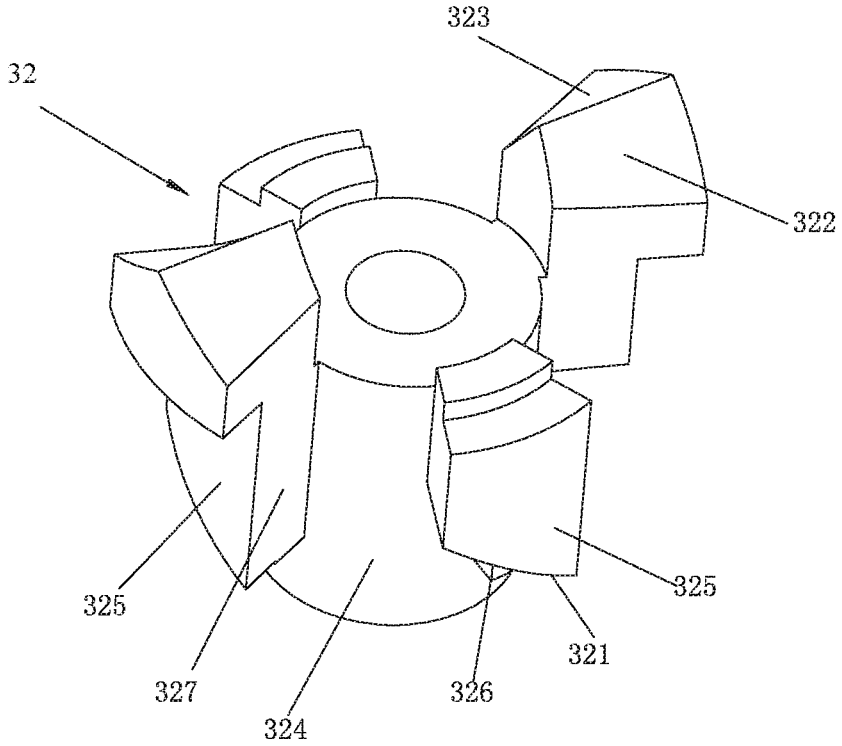
FIG. 10 illustrates a first perspective view of a movable block of Embodiment 1.
Figure 11:
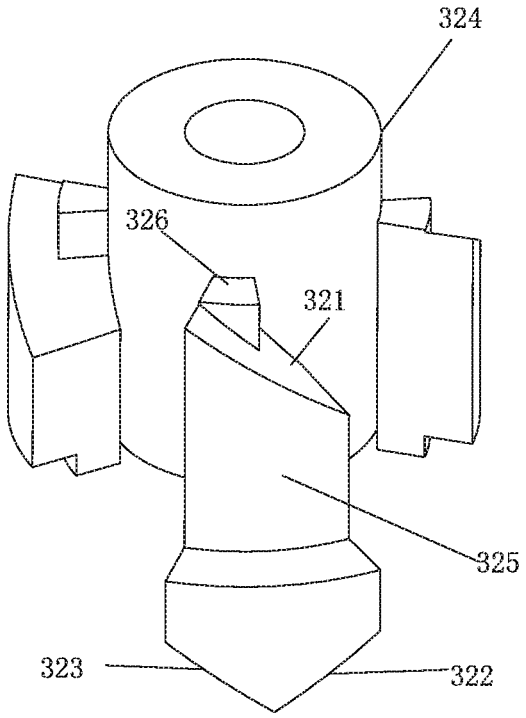
FIG. 11 illustrates a second perspective view of the movable block of Embodiment 1.

Referring to FIGS. 10 and 11, the movable block 32 comprises a lower guiding surface 321 facing downward, a third upper guiding surface 322 facing upward, and a fourth upper guiding surface 323 facing upward. The lower guiding surface 321, the third upper guiding surface 322, and the fourth upper guiding surface 323 are all spiral surfaces or inclined surfaces. A guiding direction of the third upper guiding surface 322 is opposite to a guiding direction of the fourth upper guiding surface 323, and an upper side of the third upper guiding surface 322 is connected to an upper side of the fourth upper guiding surface 323. In this embodiment, the movable block 32 comprises a body 324 and a plurality of second outer convex portions 325 extending outward from an outer periphery of the body 324. The plurality of second outer convex portions 325 are annularly arranged, and an upper portion of each of at least one of the plurality of second outer convex portions 325 comprises a convex structure to define each of the at least one of the plurality of second outer convex portions 325 to be an inverted L-shaped structure. A top surface of each of the at least one of the plurality of second outer convex portions 325 comprises the third upper guiding surface 322 and the fourth upper guiding surface 323, and a bottom surface of each of the at least one of the plurality of second outer convex portions 325 comprises the lower guiding surface 321. In a specific embodiment, the upper portion of each of at least one of the plurality of the second outer convex portions 325 protrudes outward and is disposed above the top surface of the body 324.

Figure 9:
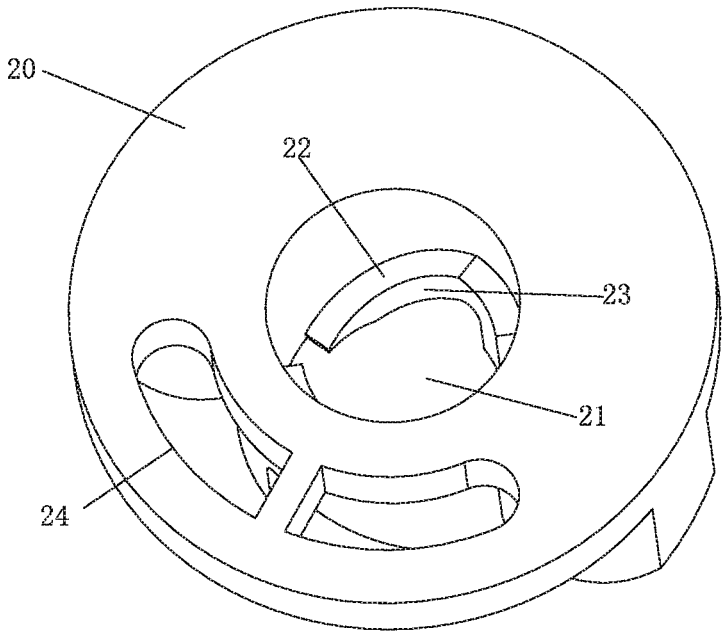
FIG. 9 illustrates a perspective view of a water dividing plate of Embodiment 1.

Referring to FIG. 9, the water dividing plate 20 comprises a first through passage 21. The first through passage 21 comprises a first inner guiding surface 22, and the first inner guiding surface 22 is a spiral surface or an inclined surface. In this embodiment, an inner wall of the first through passage 21 comprises a second inner convex portion 23 extending outward, and a bottom surface of the second inner convex portion 23 comprises the first inner guiding surface 22.

Referring to FIGS. 1-11, the push rod 31 comprises a rotation limiting groove 315. The movable block 32 comprises a rotation limiting protrusion 326. The rotation limiting protrusion 326 cooperates with the rotation limiting groove 315 to restrict the movable block 32 to rotate in a second direction. The second direction is opposite to the first direction, for example, the second direction is clockwise. In this embodiment, the rotation limiting protrusion 326 is disposed on the lower guiding surface 321 of the movable block 32. The first outer convex portion 314 comprises a protruding portion extending above the push rod 31, the protruding portion defines an angle facing inward, and the angle defines the rotation limiting groove 315.

Referring to FIGS. 1-11, a first end of the button 35 is swingably connected to the water dividing body 15, and a second end of the button 35 abuts a lower end of the push rod 31. An upper end of a central shaft 34 is fixedly connected to the fixing base 14, and the central shaft 34 defines an axial center of the plurality of matching protrusions 141 annularly arranged. The push rod 31 is slidably connected to the central shaft 34. The movable block 32 is rotatably and slidably connected to the central shaft 34. As an example, the elastic body 33 is a spring, and the elastic body 33 surrounds the central shaft 34 and is disposed between the fixing base 14 and the movable block 32 to drive the driving mechanism 30 to be reset.

The waterway switching mechanism is switched by pressing the button 35 and is reset by releasing the button 35 so as to complete a switching cycle. In some embodiments, the switching cycle of the waterway switching mechanism comprises a switching process configured to drive the water dividing plate 20 to rotate by pressing the button 35 (the water dividing plate 20 rotates at a predetermined angle to complete a switching of water spray patterns) and a reset process configured to be reset by a force of the elastic body 33 after releasing the button 35 (the driving mechanism 30 is reset). The switching process comprises a first process and a second process.

Figure 2:
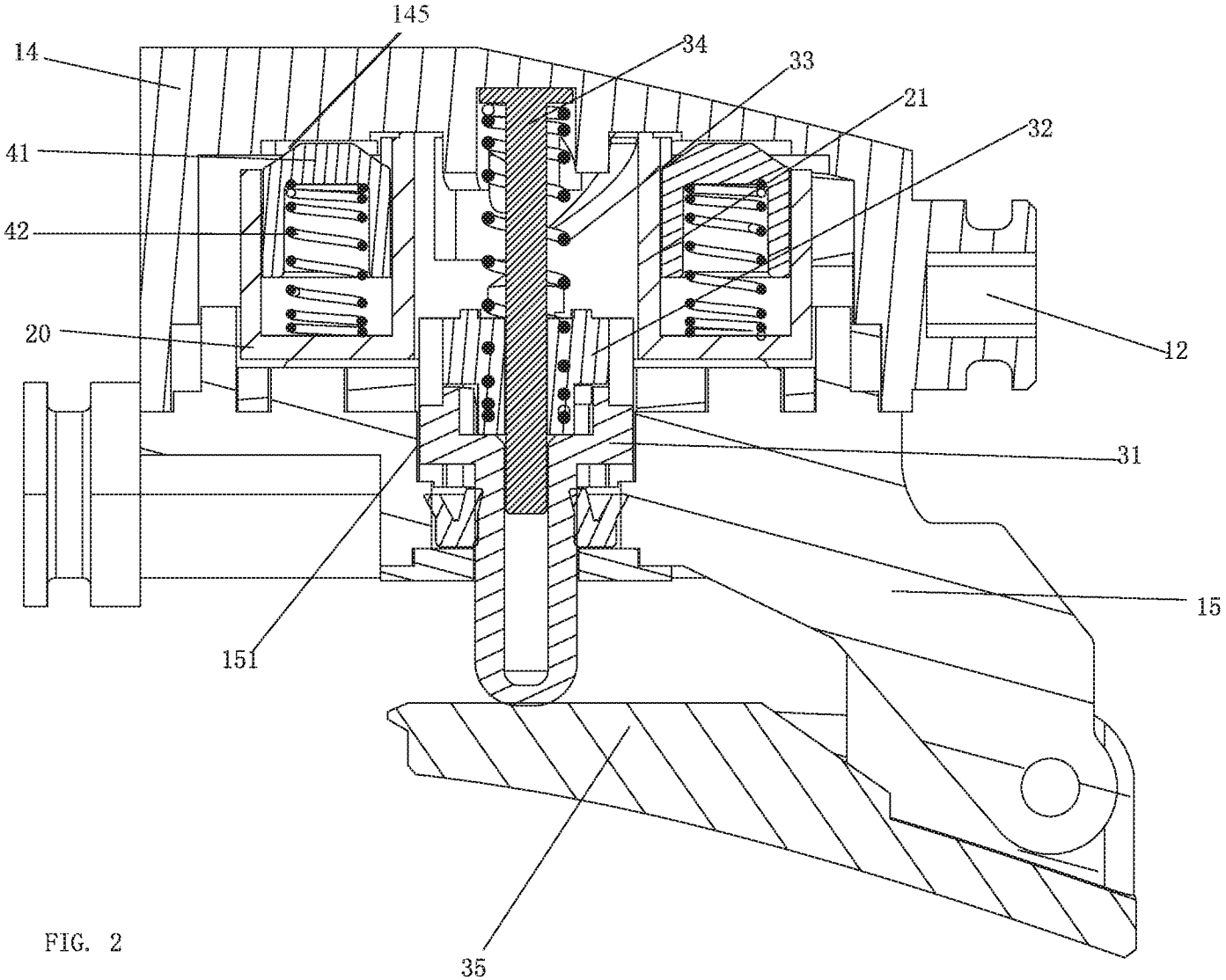
FIG. 2 illustrates a first cross-sectional view of the waterway switching mechanism of Embodiment 1.
Figure 3:
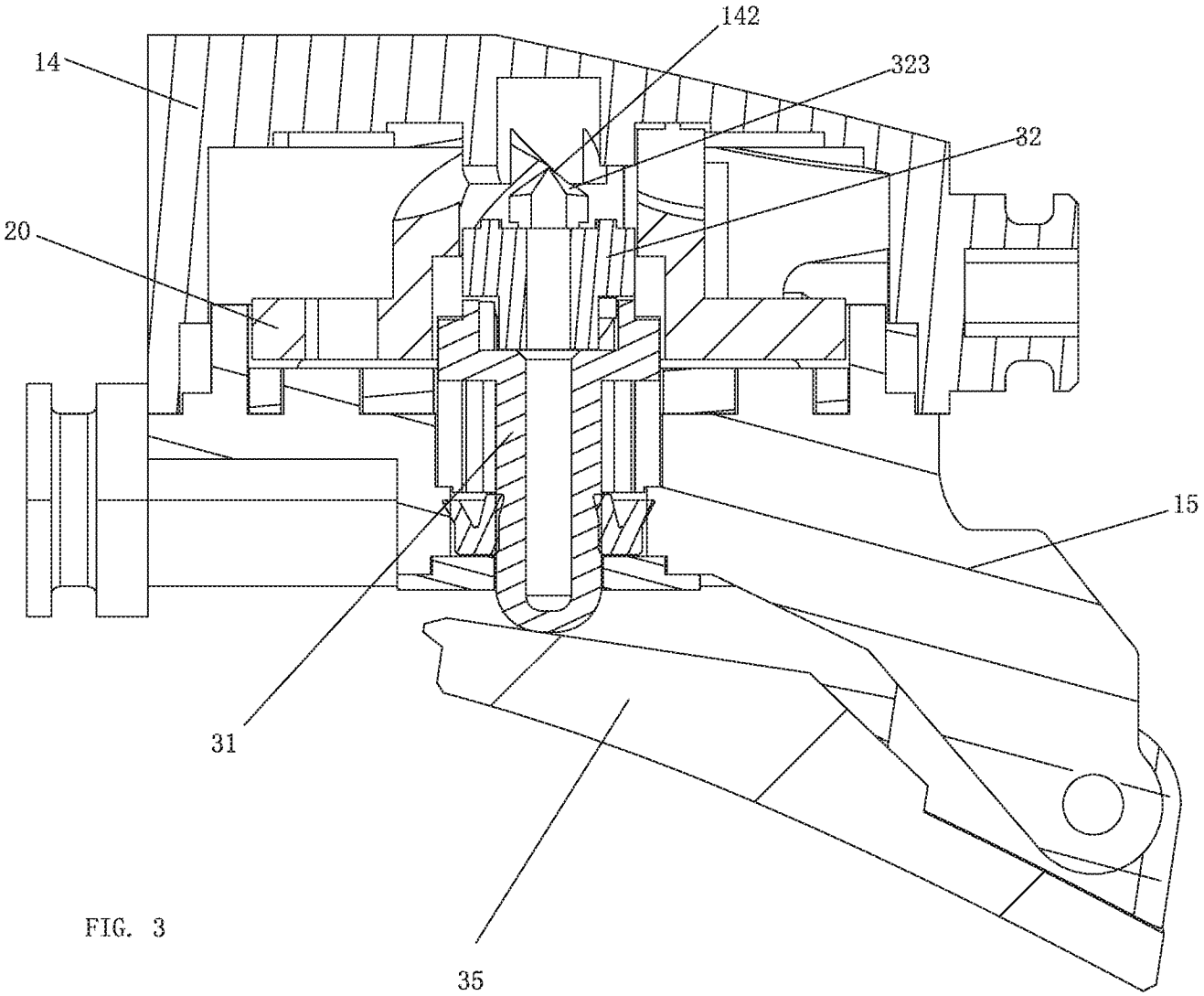
FIG. 3 illustrates a second cross-sectional view of the waterway switching mechanism of Embodiment 1.

In the first process: the water dividing plate 20 only rotates in the first direction, and the push rod 31 and the movable block 32 move without rotating. Referring to FIGS. 2 and 3, the button 35 of the driving mechanism 30 is in an initial state (ready to be pressed) in FIG. 2, and the fourth upper guiding surface 323 of the movable block 32 of the driving mechanism 30 contacts the fixing guiding surface 142 of the fixing base 14 in FIG. 3. When the button 35 is pressed, the push rod 31 moves upward. Since the lower guiding surface 321 of the movable block 32 contacts and abuts the first upper guiding surface 311 of the push rod 31, the movable block 32 also moves upward. The third upper guiding surface 322 of the movable block 32 contacts and abuts the first inner guiding surface 22 of the water dividing plate 20. Since the water dividing plate 20 only rotates and the movable block 32 moves upward, the third upper guiding surface 322 of the movable block 32 drives the water dividing plate 20 to rotate in the first direction (counterclockwise) until the lower guiding surface 321 of the movable block 32 moves away from the second inner guiding surfaces 154 of the water dividing body 15. At this time, as shown in FIG. 3, the fourth upper guiding surface 323 of the movable block 32 abuts the fixing guiding surface 142 of the fixing base 14. In this first process, the push rod 31 is free to move but not rotate, the movable block 32 is also free to move but not rotate, and the water dividing plate 20 is free to rotation. The rotation limiting protrusion 326 and the rotation limiting groove 315 cooperate to prevent the movable block 32 from rotating in a second direction (clockwise), so a rotation of the movable block 32 in the clockwise direction (the water dividing plate 20 does not move) due to an excessive friction between the water dividing plate 20 and a sealing pad 25 (the sealing pad 25 is disposed on the bottom surface of the water dividing chamber 11) is prevented.

Figure 4:
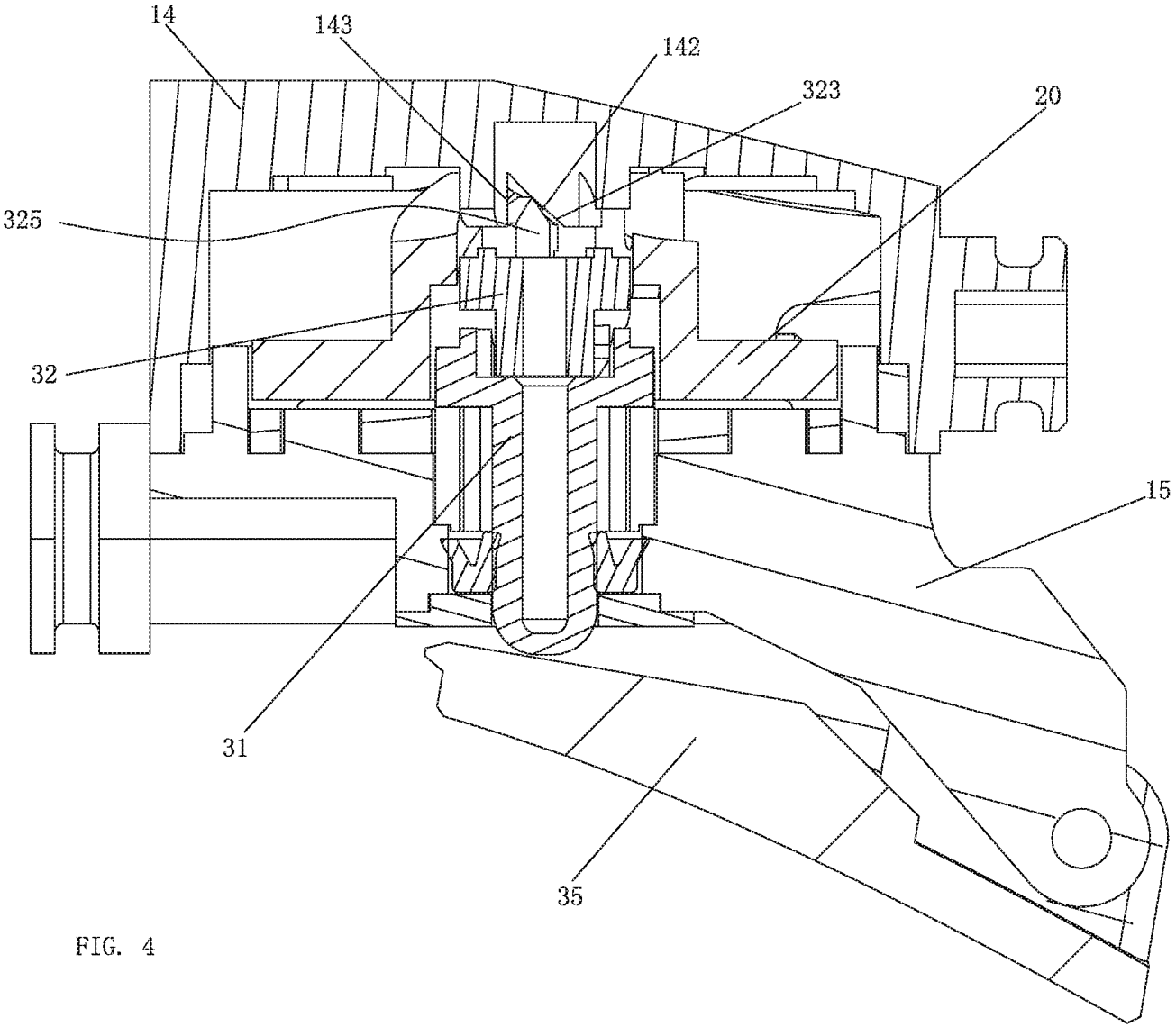
FIG. 4 illustrates a third cross-sectional view of the waterway switching mechanism of Embodiment 1.

In the second process, the water dividing plate 20 and the movable block 32 rotate together in the first direction. The water dividing plate 20 rotates at the predetermined angle by cooperation of the first process and the second process to complete the switching of the water spray patterns. The movable block 32 is free to move and to rotate in the second process. Referring to FIGS. 3 and 4, the water dividing plate 20 rotates at the predetermined angle in FIG. 4. By continuously pushing the push rod 31, and the fourth upper guiding surface 323 of the movable block 32 contacts and couples to the fixing guiding surface 142 of the fixing base 14. Since the fixing guiding surface 142 does not move, the movable block 32 can rotate (at this time, the lower guiding surface 321 of the movable block 32 separates from the second inner guiding surfaces 154 of the water dividing body 15). At this time, an upward movement of the push rod 31 drives the movable block 32 to rotate in the first direction, and the movable block 32 and the water dividing plate 20 rotate together in the first direction. When the water dividing plate 20 rotates at the predetermined angle, the lower guiding surface 321 of the movable block 32 separates from the second inner guiding surfaces 154 of the water dividing body 15. In order to ensure accuracy of a rotation position of the water dividing plate 20, when the plurality of second outer convex portions 325 of the movable block 32 (a side surface of the plurality of second outer convex portions 325) abut the limiting portions 143 of the fixing base 14, a rotation of the water dividing plate 20 is complete. At this time, the switching of waterways is complete, as shown in FIG. 4.

Figure 5:
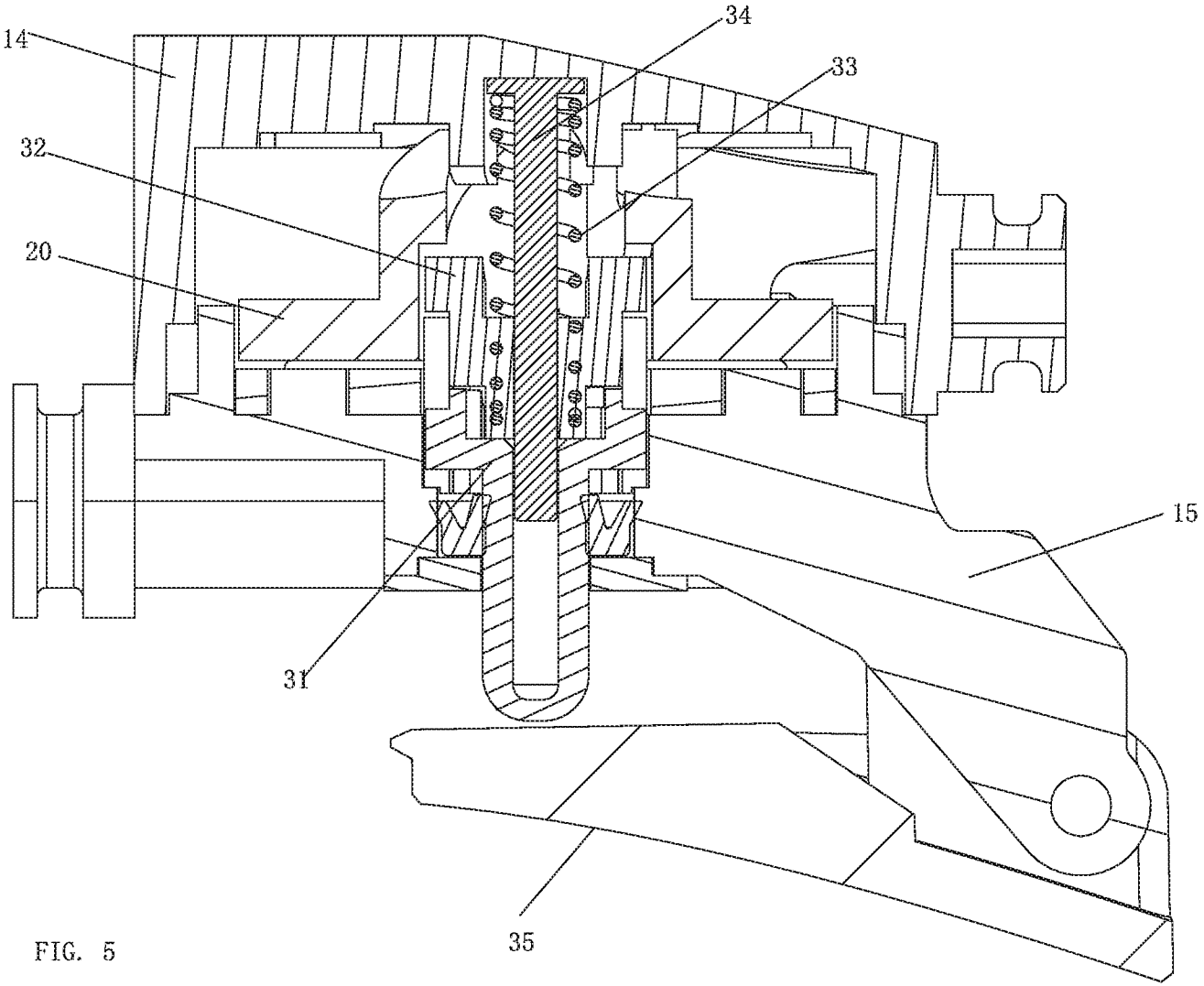
FIG. 5 illustrates a fourth cross-sectional view of the waterway switching mechanism of Embodiment 1.

In a reset process, with reference to FIGS. 4 and 5, FIG. 5 illustrates a schematic view of the water switching mechanism after the button 35 is released. After releasing a hand from the button 35, causing the button 35 to be released, the lower guiding surface 321 of the movable block 32 separates from the second inner guiding surfaces 154 of the water dividing body 15. At this time, the lower guiding surface 321 of the movable block 32 cooperates with the second inner guiding surfaces 154 of the water dividing body 15, and the movable block 32 moves downward under the force of the elastic body 33. The lower guiding surface 321 of the movable block 32 moves downward to pass through the second upper guiding surface 312 of the push rod 31 to a next switching position and to drive the push rod 31 and the button 35 to be reset simultaneously. Thus the switching cycle is complete. A rotation angle and a rotation direction of the movable block 32 are consistent with a rotation angle and a rotation direction of the water dividing plate 20 to ensure each of switching positions is fixed.

If needed, a sealing ring 155 and a retaining ring 156 are disposed between the lower end of the push rod 31 and the water dividing body 15. The sealing ring 155 and the retaining ring 156 surround the push rod 31 and are disposed in the second through passage 151 of the water dividing body 15. A positioning mechanism is disposed between the water dividing plate 20 and the fixing base 14. The positioning mechanism comprises a positioning pin 41 movably connected to the water dividing plate 20, an abutting spring 42 abutting the positioning pin 41, and a positioning groove 145 disposed in the fixing base 14. The positioning pin 41 is inserted into the positioning groove by the abutting spring to enable the waterway switching mechanism to be maintained in a switching state to improve a switching feel of the waterway switching mechanism.

In this embodiment, the water dividing plate 20 only rotates (the water dividing plate 20 does not move), and the mounting portion 10 and the water dividing plate 20 can be made from general materials. A filling process is not required, a cost can be reduced, an occupied space can be reduced, and the structure is compact.

Figure 15:
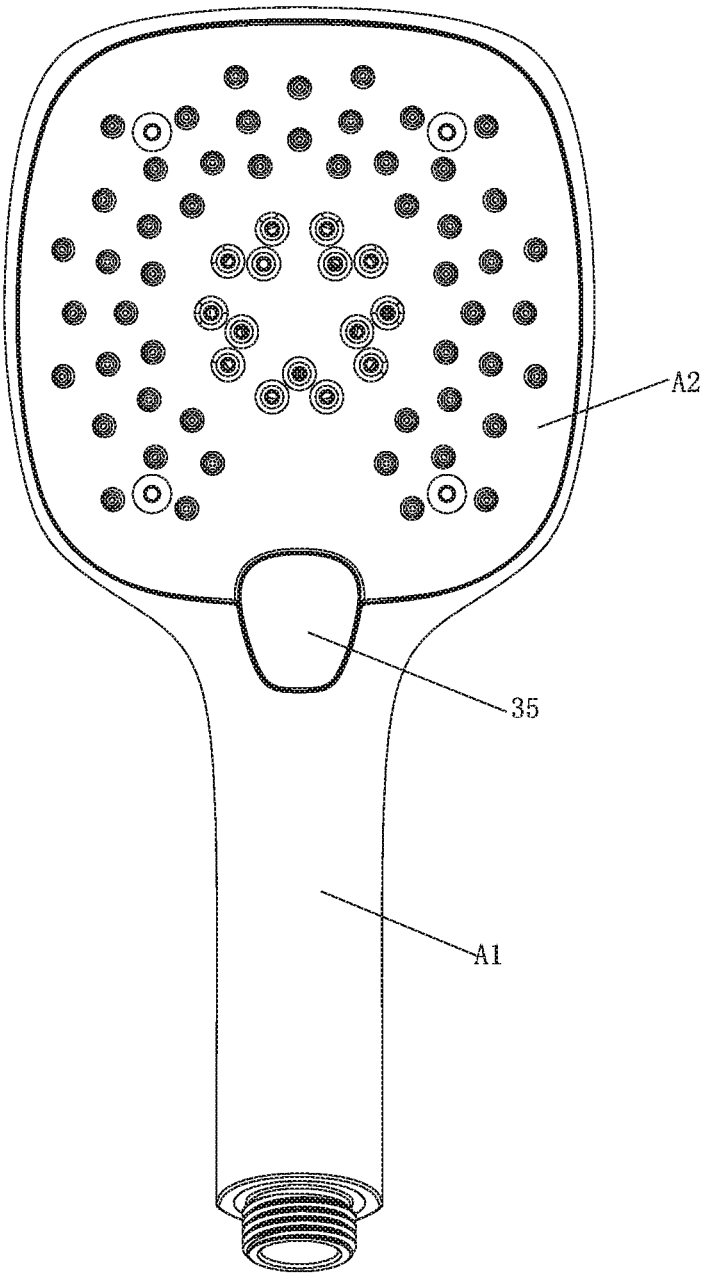
FIG. 15 illustrates a perspective view of a shower comprising the waterway switching mechanism of Embodiment 1.
Figure 16:
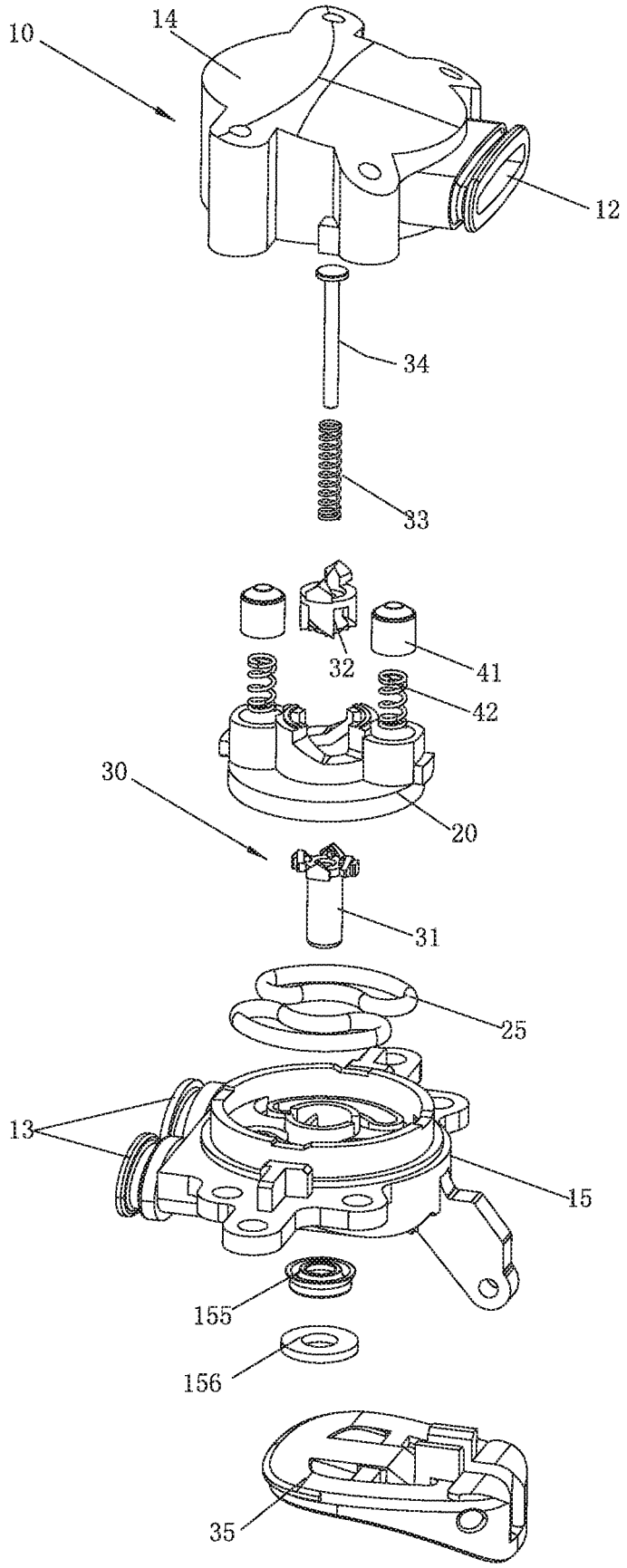
FIG. 16 illustrates an exploded perspective view of a waterway switching mechanism of Embodiment 2.
Figure 17:
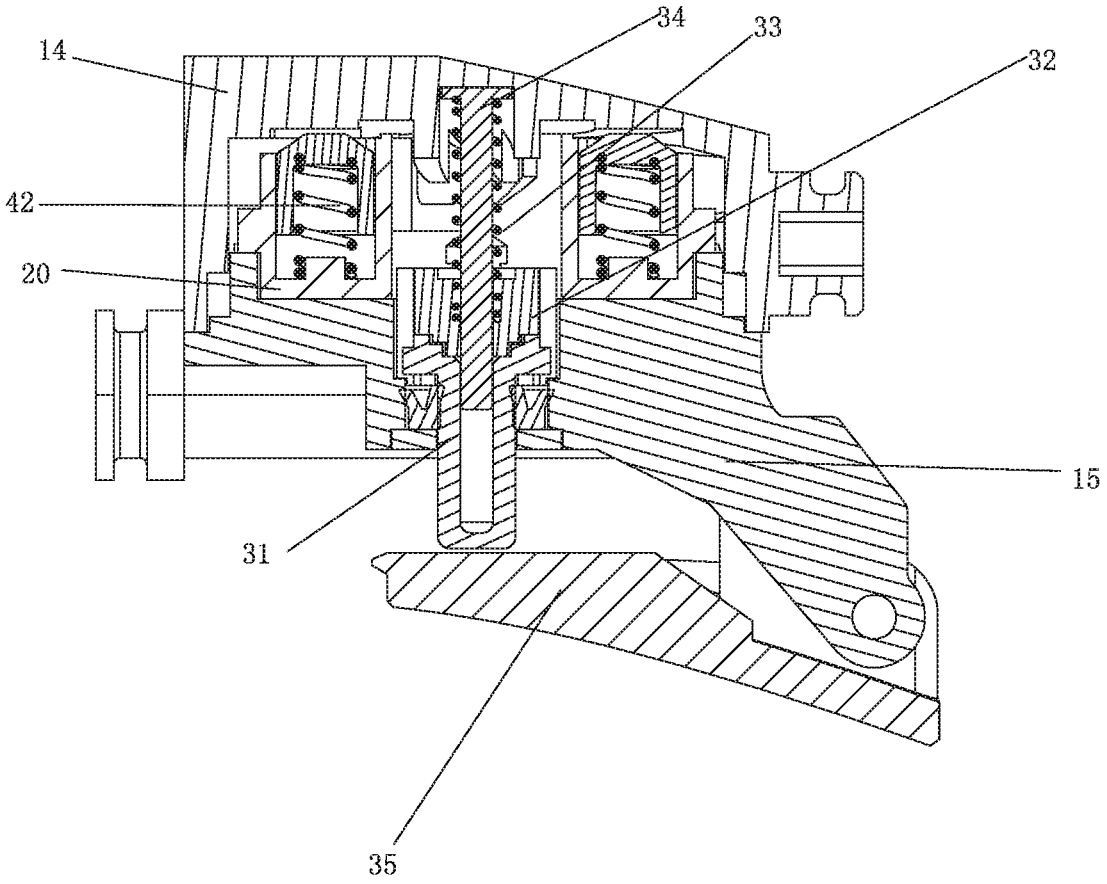
FIG. 17 illustrates a cross-sectional view of the waterway switching mechanism of Embodiment 2.
Figure 18:
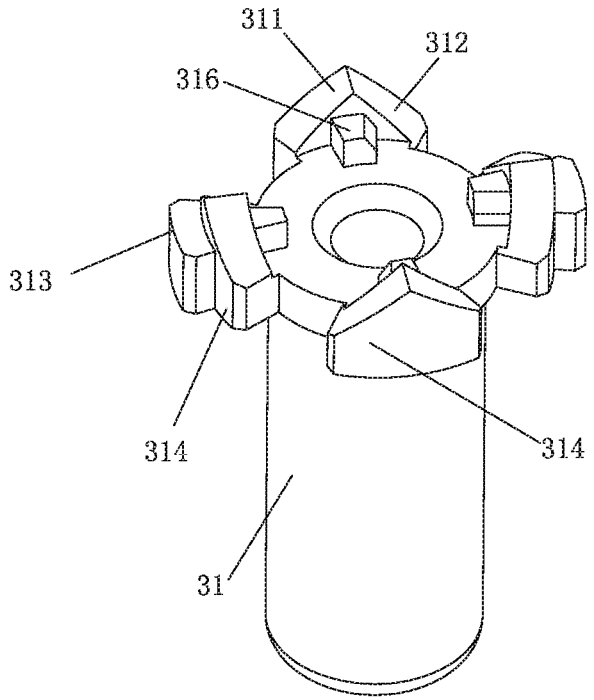
FIG. 18 illustrates a perspective view of a push rod of Embodiment 2.
Figure 19:
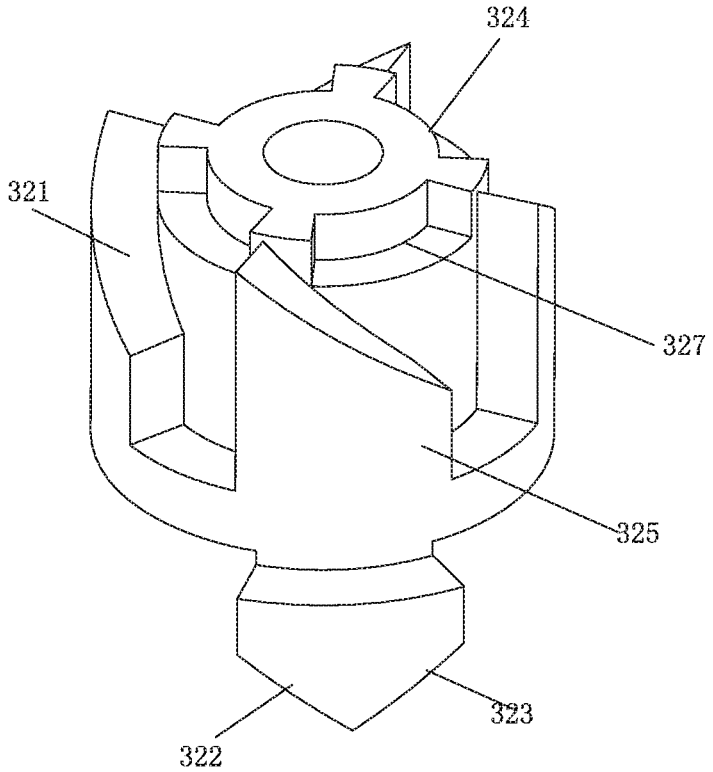
FIG. 19 illustrates a perspective view of a movable block of Embodiment 2.
Figure 20:
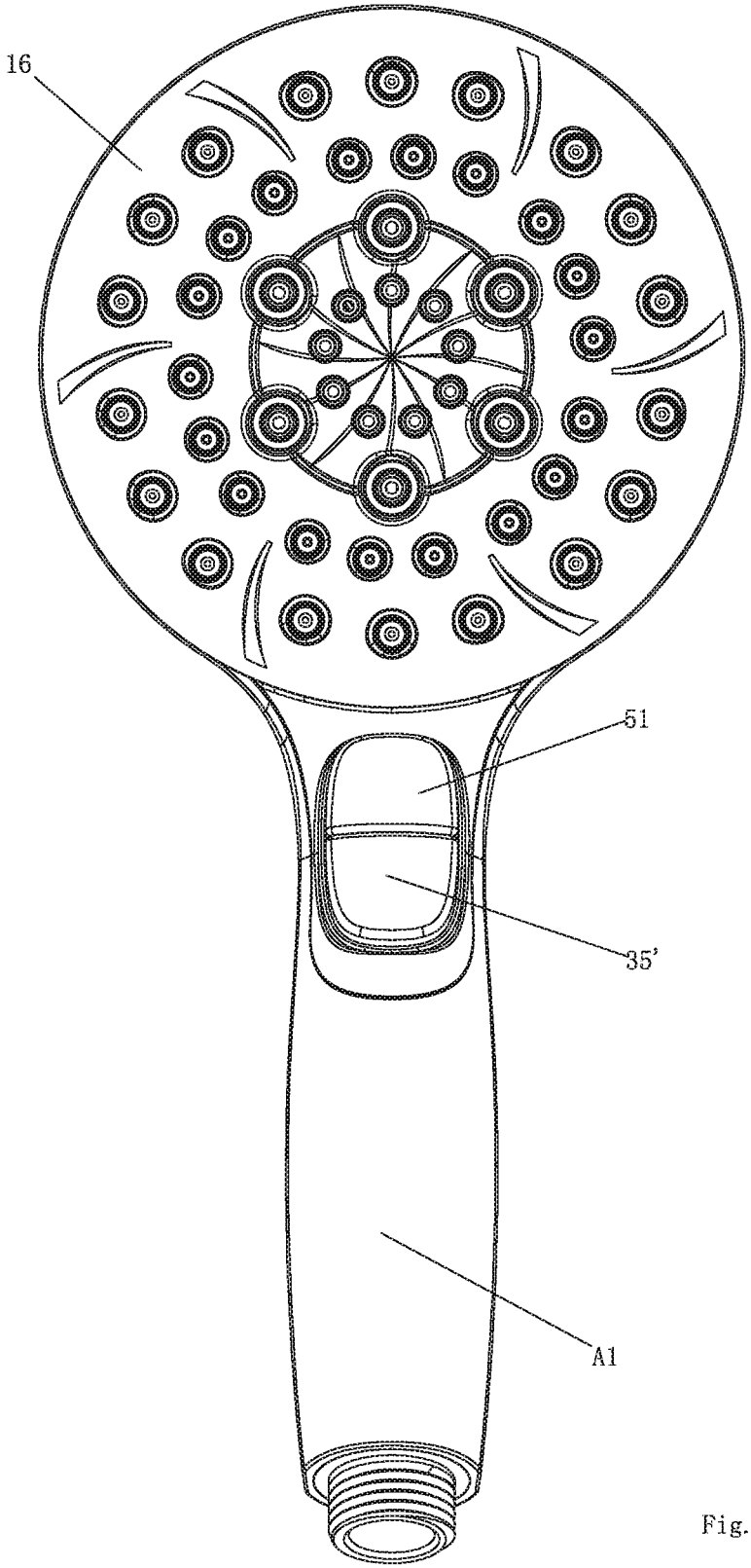
FIG. 20 illustrates a perspective view of a shower of Embodiment 3.
Figure 21:
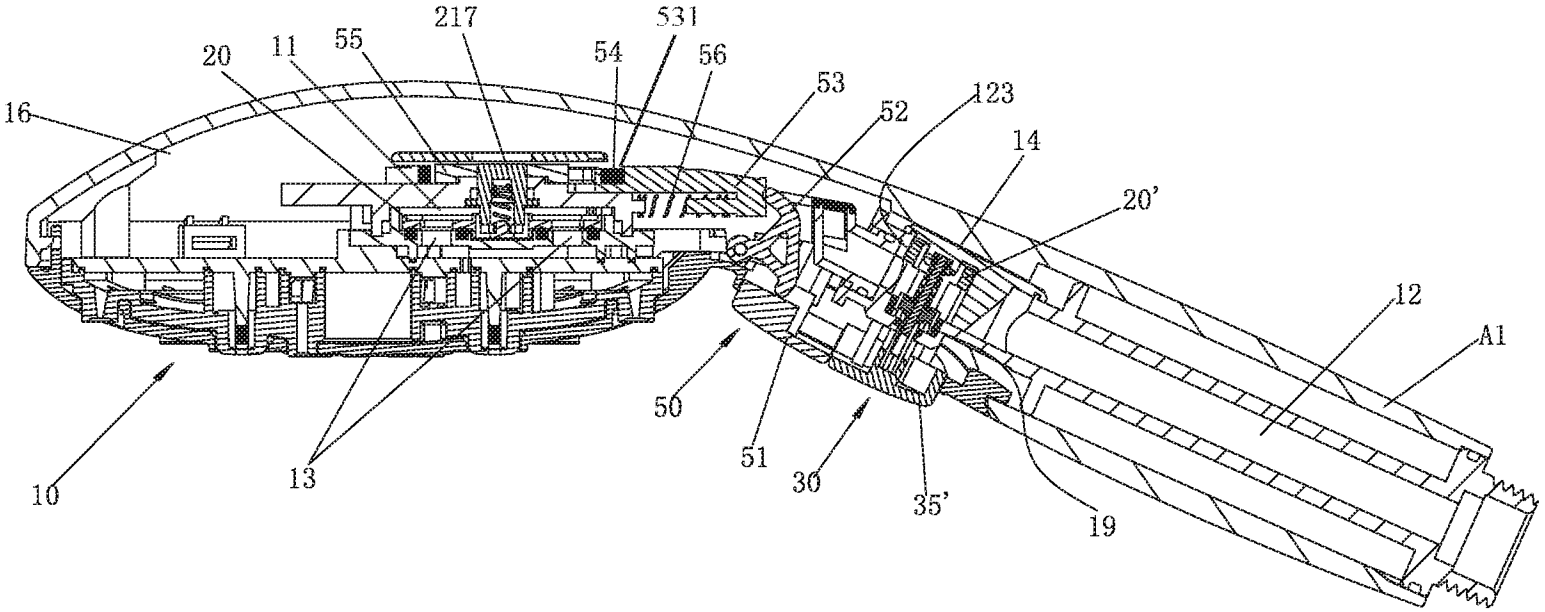
FIG. 21 illustrates a cross-sectional view of the shower of Embodiment 3.
Figure 22:
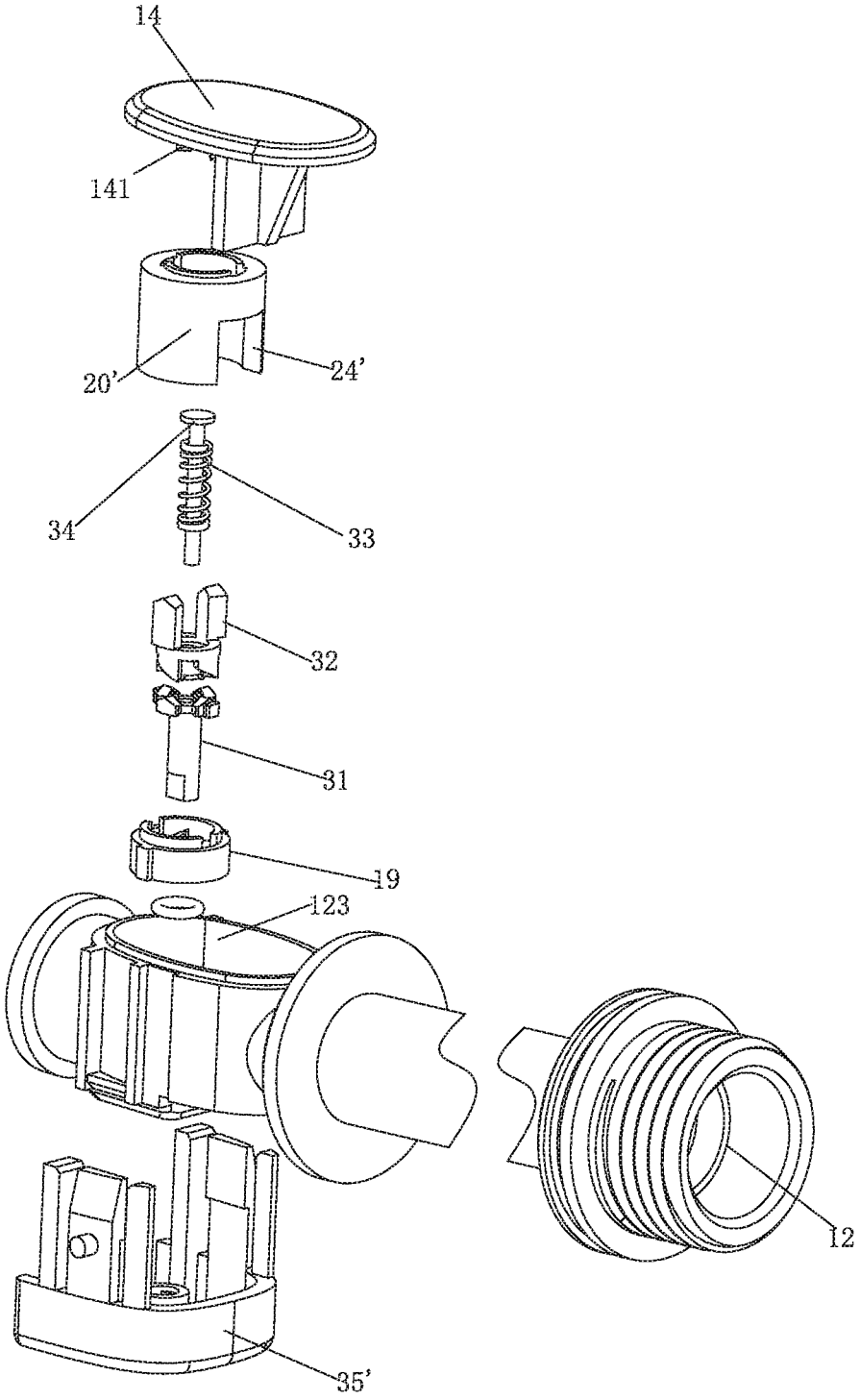
FIG. 22 illustrates an exploded perspective view of the waterway switching mechanism of Embodiment 3.
Figure 23:
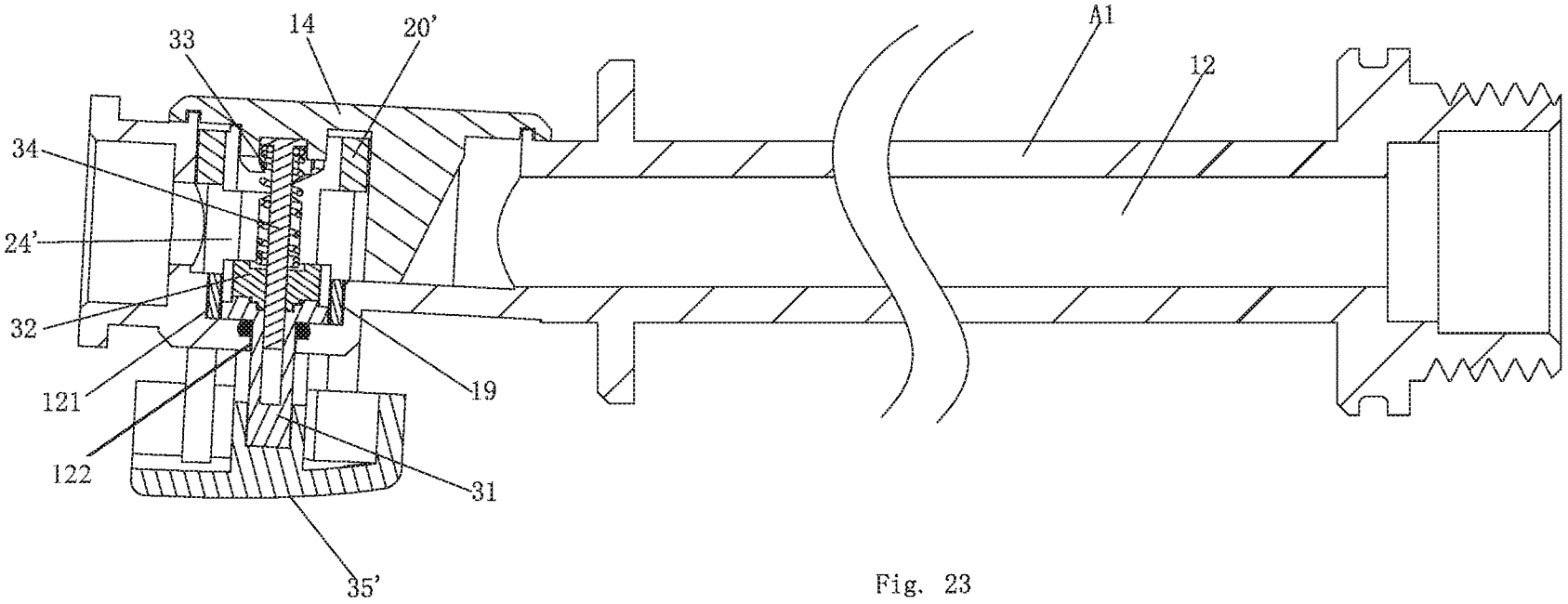
FIG. 23 illustrates a cross-sectional view of the waterway switching mechanism of Embodiment 3 when water flows out from the waterway switching mechanism.
Figure 24:
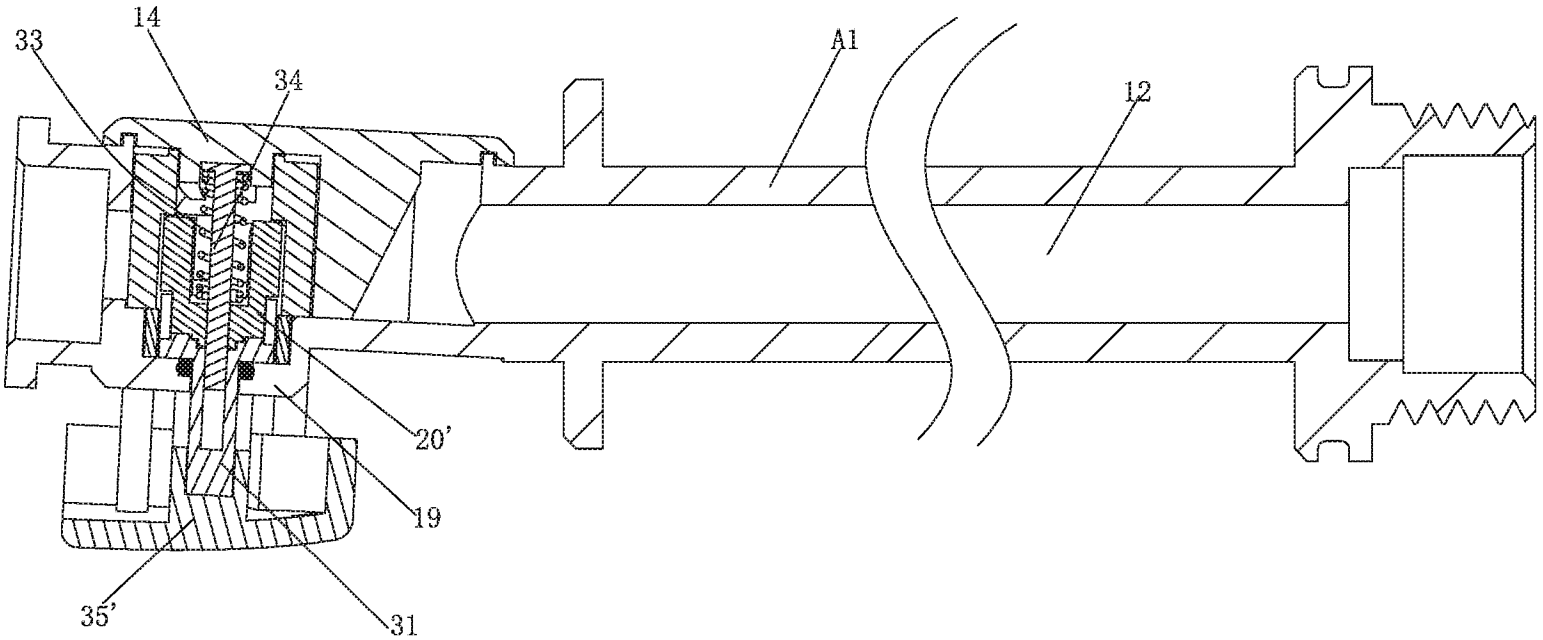
FIG. 24 illustrates a cross-sectional view of the waterway switching mechanism of Embodiment 3 when water does not flow out from the waterway switching mechanism.
Figure 25:
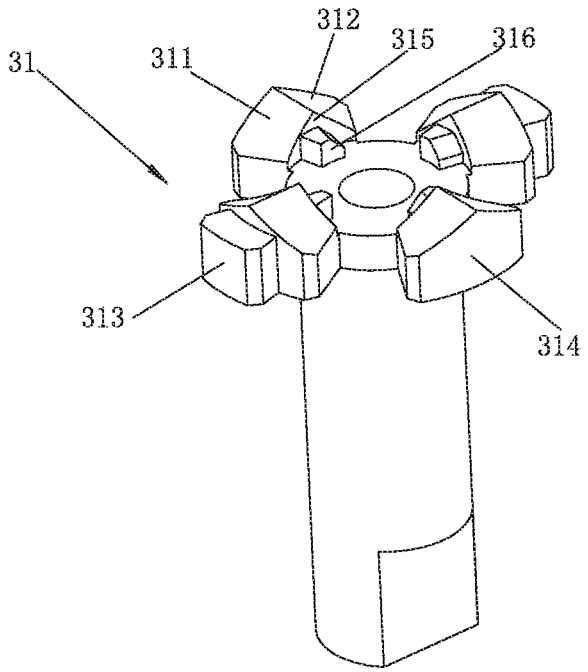
FIG. 25 illustrates a perspective view of a push rod of the waterway switching mechanism of Embodiment 3.
Figure 26:
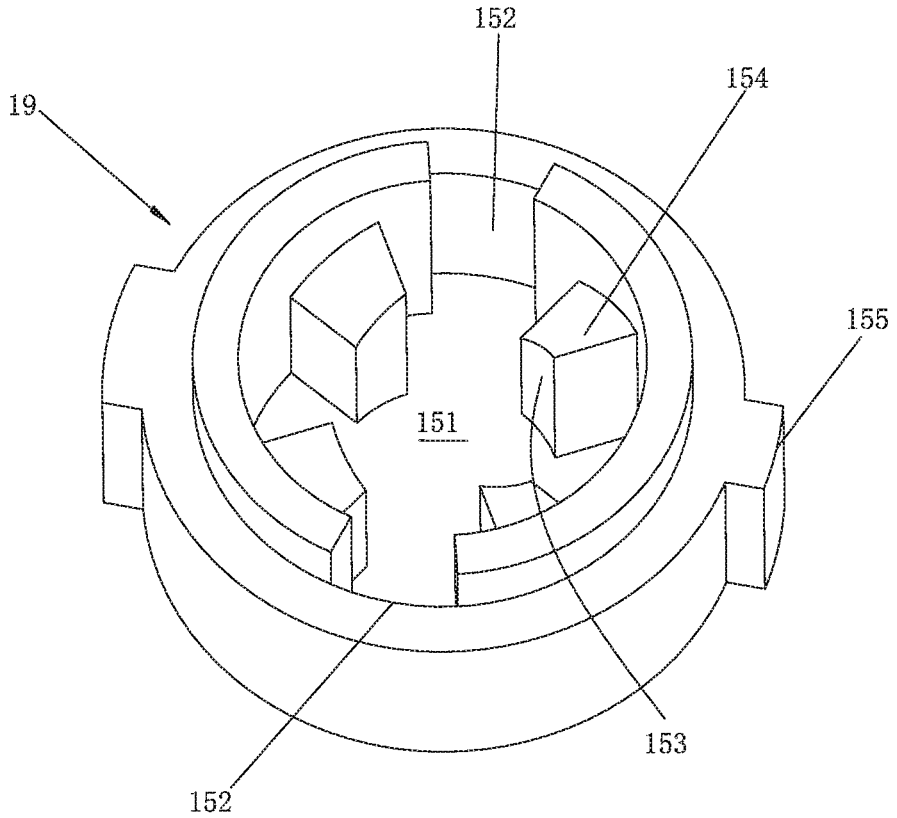
FIG. 26 illustrates a perspective view of a valve body of the waterway switching mechanism of Embodiment 3.
Figure 27:
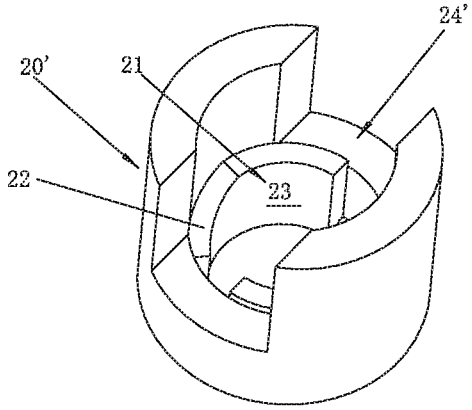
FIG. 27 illustrates a perspective view of a driven disk of the waterway switching mechanism of Embodiment 3.
Figure 30:
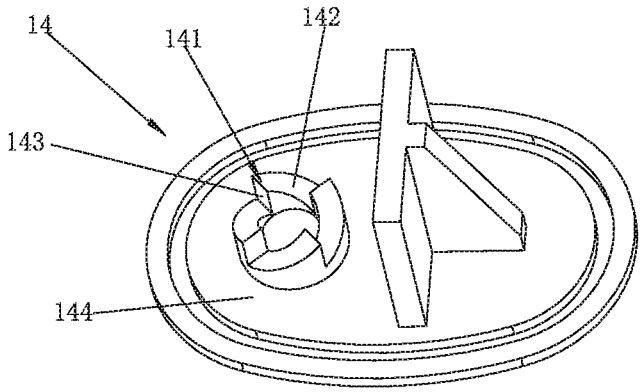
FIG. 30 illustrates a perspective view of a fixing base of the waterway switching mechanism of Embodiment 3.
Figure 28:
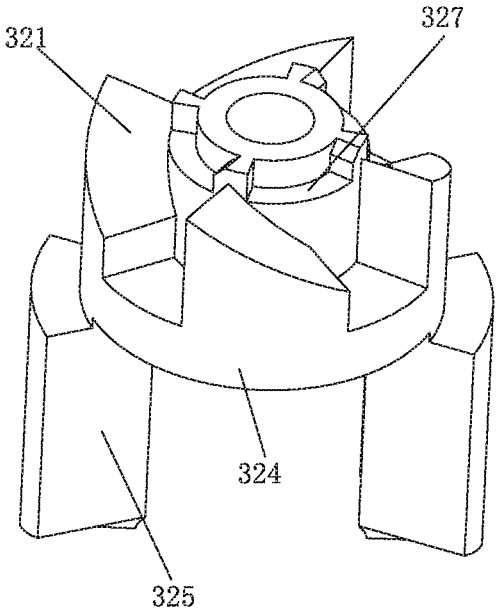
FIG. 28 illustrates a first perspective view of a movable block of the waterway switching mechanism of Embodiment 3.
Figure 29:
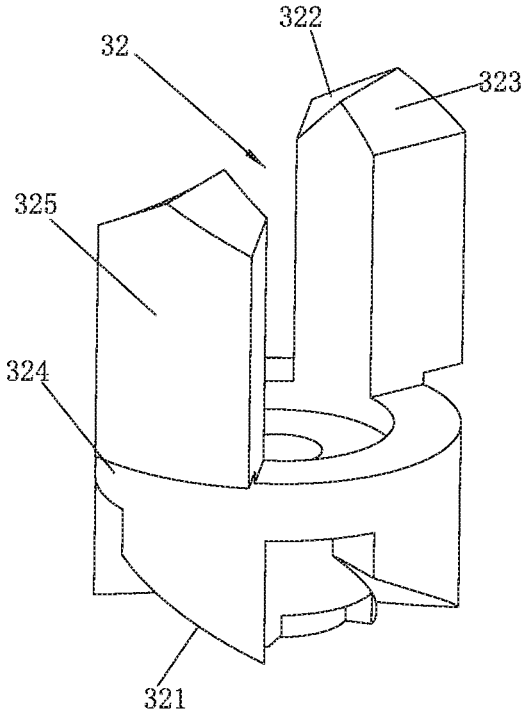
FIG. 29 illustrates a second perspective view of the movable block of the waterway switching mechanism of Embodiment 3.

FIG. 15 illustrates a shower in which the waterway switching mechanism of this embodiment is applied. The shower is a handheld shower, and the handheld shower comprises a handheld portion A1 and a shower portion A2. The waterway switching mechanism is disposed in the shower. The button 35 is exposed on an outer side of the shower for the user to press. For example, the button 35 is disposed on a joint of the handheld portion A1 and the shower portion A2.

Embodiment 2

Referring to FIGS. 16-19, this embodiment differs from Embodiment 1 in that the structure configured to restrict the rotation of the movable block 32 in the second direction is different from that of Embodiment 1. In this embodiment, the first outer convex portion 314 comprises an extending portion extending above the push rod 31, and the protruding portion of the first outer convex portion 314 defines the angle facing inward. A rotation limiting member 316 is fixedly disposed at an intersection of the first upper guiding surface 311 and the second upper guiding surface 312. A periphery of a bottom of the body 324 of the movable block 32 comprises an arc-shaped opening 327 extending inward. The number of arc-shaped openings 327 is the same as the number of first outer convex portions 314 (the number of rotation limiting members 316 is the same as the number of arc-shaped openings 327), and the rotation limiting member 316 is connected to the arc-shape opening 327 to prevent the movable block 32 from rotating in the second direction by the aforementioned connection.

Embodiment 3

Referring to FIGS. 20-30, this embodiment differs from Embodiment 1 in that, in Embodiment 3, the water inlet passage 12 is considered to be a first water dividing passage and a plurality of other water dividing passages 13 are controlled to be switched to be connected with the water inlet passage 12. That is, the plurality of water dividing passages 13 are controlled to be open and to be closed. In this embodiment, a water passage is controlled to be closed or to be open. In some embodiments, with reference to FIGS. 20-30, a handheld shower comprises a waterway switching mechanism. The waterway switching mechanism comprises a driving mechanism 30, a mounting portion 10, a driven plate 20', a water dividing plate 20, and a ratchet wheel-ratchet intermittent movement mechanism 50. In this embodiment, for example, the driven plate 20' is driven to rotate to control the water passage to be closed and to be open. The driving mechanism 30 of Embodiment 1 is substantially the same as the driving mechanism 30 of this embodiment. In Embodiment 1, the water dividing plate 20 comprises the water hole 24, while the driven plate 20' comprises water groove 24' in this embodiment. A button of the driving mechanism 30 is a first button 35'.

The mounting portion 10 comprises the handheld portion A1 and a head 16. The mounting portion 10 comprises the water inlet passage 12. A first portion of the water inlet passage 12 is disposed on the handheld portion A1, and a second portion of the water inlet passage 12 is disposed on the head 16. A bottom wall of the water inlet passage 12 comprises a mounting groove 121, and a bottom of the mounting groove 121 comprises a connection groove connected to an outer side of the handheld portion A1. A top side of the water inlet passage 12 comprises a through groove 123 passing through the water inlet passage 12.

The driven plate 20' is disposed above the water inlet passage 12 of the handheld portion A1 and is configured to rotate relative to the handheld portion A1. The handheld portion A1 comprises an upper matching portion 14' and a lower matching portion 15'. The upper matching portion 14' is the fixing base 14, and the lower matching portion 15' is a valve body 19.

The fixing base 14 comprises a fixing board 144 and the plurality of matching protrusions 141. The plurality of matching protrusions 141 are fixedly and annularly arrayed on the bottom surface of the fixing base 14, and each of the plurality of matching protrusions 141 comprises the fixing guiding surface 142 and the limiting portion 143, as illustrated in Embodiment 1. The fixing board 144 of the fixing base 14 is fixedly and hermetically sealed on the through groove 123 of the handheld portion A1.

The valve body 19 comprises the second through passage 151. The second through passage 151 passing through the valve body in a vertical direction. The second through passage 151 comprises the guide grooves 152, the plurality of first inner convex portions 153, and the second inner guiding surfaces 154. The valve body 19 is disposed in the mounting groove 121.

A tail end (e.g., a lower end) of the push rod 31 upwardly passes through the second through passage 151 of the valve body 19 and the connection groove 122 of the handheld portion A1 to enable the push rod 31 to be slidably and hermetically sealed to the connection groove 122. As illustrated in Embodiment 2, the push rod 31 comprises the first upper guiding surface 311 facing upward and the second upper guiding surface 312 facing upward. The outer periphery of the push rod 31 comprises the two guide protrusions 313 extending outward, and the two guide protrusions 313 couple to the guide grooves 152 of the second through passage 151 of the valve body 19 to enable the push rod 31 to be slidably connected to the second through passage 151. The outer periphery of the push rod 31 further comprises a first outer convex portion 314 extending outward. The first outer convex portion 314 comprises a protruding portion extending above the push rod 31. The protruding portion defines an angle facing inward, and a rotation limiting member 316 is fixedly disposed at an intersection of the first upper guiding surface 311 and the second upper guiding surface 312.

The movable block 32 comprises the lower guiding surface 321 facing downward, the third upper guiding surface 322 facing upward, and the fourth upper guiding surface 323 facing upward. The movable block 32 also comprises the body 324 and the plurality of second outer convex portions 325 extending outward from an outer periphery of the body 324. The plurality of second outer convex portions 325 are annularly arranged, and the upper portion of each of the at least one of the plurality of second outer convex portions 325 comprises the convex structure to define each of the at least one of the plurality of second outer convex portions 325 to be the inverted L-shaped structure. The top surface of each of the at least one of the plurality of second outer convex portions 325 comprises the third upper guiding surface 322 and the fourth upper guiding surface 323, and the bottom surface of each of the at least one of the plurality of second outer convex portions 325 comprises the lower guiding surface 321. The periphery of the bottom of the body 324 of the movable block 32 comprises the arc-shaped opening 327 extending inward. The number of arc-shaped openings 327 is the same as the number of first outer convex portions 314 (the number of rotation limiting members 316 is the same as the number of arc-shaped openings 327). As illustrated in Embodiment 2, the rotation limiting member 316 is connected to the arc-shape opening 327 to prevent the movable block 32 from rotating in the second direction by the aforementioned connection.

The driven plate 20' comprises the first through passage 21, and first through passage 21 comprises the first inner guiding surface 22. The driven plate 20' is disposed between the mounting groove 121 and the through groove 123 of the water inlet passage 12, and an assembly is convenient. The driven plate 20' comprises a side wall, and the first through passage 21 is disposed in the side wall. An end surface of the side wall comprises the water groove 24' passing through the side wall, and the first inner guiding surface 22 is disposed in the peripheral wall. The inner wall of the first through passage 21 comprises a second inner convex portion 23 extending outward, and a bottom surface of the second inner convex portion 23 comprises the first inner guiding surface 22. When the waterway switching mechanism is open, the water groove 24' of the driven plate 20' defines a part of the water inlet passage 12. When the waterway switching mechanism is closed, a side wall of the water groove 24' contacts the water inlet passage 12 to close the water inlet passage 12. The structure is simple, the side wall is configured to control the waterway switching mechanism to be closed and to be open, a hermetical seal is good, a pressing force is small, and the waterway switching mechanism is convenient to control. In some embodiments, the water inlet passage 12 comprises a front portion and a rear portion, and the driven plate 20' is disposed between the front portion and the rear portion. When the waterway switching mechanism is open, the front portion is connected to the rear portion. When the waterway switching mechanism is closed, the front portion is not connected to the rear portion.

A first end of the first button 35' is slidably connected the handheld portion A1, and an inner wall of the first button 35' is fixedly connected to the tail end of the push rod 31. The central shaft 34 is fixedly connected to the fixing base 14, and the central shaft 34 defines the axial center of the plurality of matching protrusions 141 that are annularly arranged. The push rod 31 is slidably connected to the central shaft 34. The movable block 32 is rotatably and slidably connected to the central shaft 34. For example, the elastic body 33 is a spring, and the elastic body 33 surrounds the central shaft 34 and abuts between the fixing base 14 and the movable block 32 to drive the driving mechanism 30 to be reset.

The driving mechanism 30, the driven plate 20' (also referred to as the water dividing plate 20'), etc. define a switching mechanism configured to control the water inlet passage 12 to be closed and to be open.

The switching mechanism is switched by pressing the first button 35' and is reset by releasing the first button 35' so as to complete a switching cycle. In some embodiments, the switching cycle of the switching mechanism comprises a switching process configured to drive the driven plate 20' to rotate by pressing the first button 35' (the driven plate 20' rotates at a predetermined angle to control the waterway to be closed and to be open) and a reset process configured to be reset by a force of the elastic body 33 after releasing the first button 35' (the driving mechanism 30 is reset). The switching process comprises a first process and a second process.

In the first process, the driven plate 20' only rotates in the first direction, and the push rod 31 and the movable block 32 move but do not rotate. When the first button 35' is pressed to drive the push rod 31 to move upward, since the lower guiding surface 321 of the movable block 32 contacts and abuts the first upper guiding surface 311 of the push rod 31, the movable block 32 also moves upward. The third upper guiding surface 322 of the movable block 32 contacts and abuts the first inner guiding surface 22 of the driven plate 20'. Since the driven plate 20' only rotates and the movable block 32 moves upward, the third upper guiding surface 322 of the movable block 32 drives the driven plate 20' to rotate in the first direction (counterclockwise) until the lower guiding surface 321 of the movable block 32 moves away from the second inner guiding surfaces 154 of the water dividing body 15. At this time, the fourth upper guiding surface 323 of the movable block 32 abuts the fixing guiding surface 142. In the first process, the push rod 31 is free to move but not rotate, the movable block 32 is also free to move but not rotate, and the driven plate 20' is free to rotate. The rotation limiting member 316 and the arc-shaped opening 327 cooperate to prevent the movable block 32 from rotating in the second direction (clockwise).

In the second process, the driven plate 20' and the movable block 32 rotate together in the first direction. The driven plate 20' rotates at the predetermined angle by cooperation of the first process and the second process to control the waterway to be closed and to be open. The movable block 32 is free to move and rotate in the second process. By continuously pushing the push rod 31, the fourth upper guiding surface 323 of the movable block 32 contacts and couples to the fixing guiding surface 142. Since the fixing guiding surface 142 does not move, the movable block 32 can rotate. At this time, an upward movement of the push rod 31 drives the movable block 32 to rotate in the first direction, and the movable block 32 and the driven plate 20' rotate together in the first direction. When the driven plate 20' rotates at the predetermined angle, the lower guiding surface 321 of the movable block 32 separates from the second inner guiding surfaces 154 of the valve body 19. In order to ensure accuracy of a rotation position of the driven plate 20', when the plurality of second outer convex portions 325 of the movable block 32 abut the limiting portions 143, a rotation of the driven plate 20' is complete. At this time, a switching of the waterway is complete.

In the reset process, after releasing the hand from the first button 35', causing the first button 35' to be released, the lower guiding surface 321 of the movable block 32 separates from the second inner guiding surfaces 154. At this time, the lower guiding surface 321 cooperates with the second inner guiding surfaces 154. The movable block 32 moves downward under the force of the elastic body 33, and the lower guiding surface 321 moves downward to pass through the second upper guiding surface 312 to a next position and to drive the push rod 31 and the first button 35' to be reset simultaneously. Thus, the switching cycle is complete. A rotation angle and a rotation direction of the movable block 32 are consistent with a rotation angle and a rotation direction of the driven plate 20' to ensure the switching position is fixed.

In this embodiment, the first upper guiding surface 311 of the push rod 31 contacts and couples to the lower guiding surface 321 of the movable block 32 to enable the push rod 31 to push the movable block 32 to move. The third upper guiding surface 322 of the movable block 32 contacts and couples to the first inner guiding surface 22 of the driven plate 20' to enable the movable block 32 to push the driven plate 20' to move along the first direction. The movable block 32 couples to the fixing guiding surface 142 of the fixing base 14 to enable the push rod 31 to drive the movable block 32 and the driven plate 20' to move along the first direction together. The driven plate 20' is configured to control the water inlet passage 12 to be closed and to be open. When the driven plate 20' is rotated to a preset position when the first button 35' is pressed, the driven plate 20' only needs to resist the elastic reset force. The elastic reset force is small, and therefore a pressing force is small.

In this embodiment, the driven plate 20' only rotates (the driven plate 20' does not move), and the mounting portion 10 and the driven plate 20' can be made from general materials. A filling process is not required, a cost can be reduced, an occupied space can be reduced, and the structure is compact.

The head 16 of the mounting portion 10 comprises the water dividing chamber 11 and the plurality of water dividing passages 13. The water dividing plate 20 is rotatably disposed in the water dividing chamber 11 of the mounting portion 10, and the water dividing plate 20 rotates to at least control the plurality of water dividing passages 13 to be connected to the water dividing chamber 11. The water dividing plate 20 comprises a water dividing shaft 217 extending out from the water dividing chamber 11. The handheld portion A1 is slidably connected to a second button 51. The ratchet wheel-ratchet intermittent movement mechanism 50 is operatively connected to the water dividing shaft 217 disposed between the second button 51 and the water dividing plate 20 to control the water dividing plate 20 to rotate at the predetermined angle to achieve the switching of the waterways by pressing the second button 51. The ratchet wheel-ratchet intermittent movement mechanism 50 comprises a swing member 52 disposed on the mounting portion 10, a slide member 53 slidably connected to the mounting portion 10, a ratchet 54, a ratchet wheel 55, and a stop claw. The ratchet wheel 55 and the water dividing shaft 217 of the water dividing plate 20 are coaxial, and the ratchet wheel 55 is disposed on an end portion of the water dividing shaft 217 extending out from the water dividing chamber 11. A first end of the ratchet 54 is rotatably connected to the mounting portion 10, a middle potion of the ratchet 54 is connected to the slide member 53, and a second end of the ratchet 54 abuts the ratchet wheel 55. The slide member 53 slides to drive the ratchet 54 to swing, so that the ratchet 54 drives the ratchet wheel 55 to rotate. A first end of the stop claw is rotatably connected to the mounting portion 10, and a second end of the stop claw abuts the ratchet wheel 55 to prevent the ratchet wheel 55 from rotating in reverse. In this embodiment, the slide member 53 comprises a through groove 531 extending inward, and the middle portion of the ratchet 54 is disposed in the through groove. The swing member 52 is a fan-shaped structure, and a central portion of the fan-shaped structure rotatably connects to the mounting portion 10. A first end of the second button 51 abuts a first end of the fan-shaped structure, and a second end of the fan-shaped structure abuts an end of the slide member 53. A reset spring 56 is disposed between the slide member 53 and the mounting portion 10.

The first button 35' and the second button 51 are arranged on the handheld portion A1 to facilitate the user controlling on-off switching and waterway switching. The first button 35' and the second button 51 define a switching mechanism having two buttons. When pressing a front button (the second button 51), the switching of the waterways is achieved. When pressing a rear button (the first button 35'), the switching of the on-off of the waterway is achieved. The two buttons are separately operated and do not affect each other.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A waterway switching mechanism, comprising:
a mounting portion,
a water dividing plate, and
a driving mechanism, wherein:
the mounting portion comprises at least one water dividing passage,
the water dividing plate is disposed in the mounting portion and cooperates with the at least one water dividing passage to switch a waterway through rotation of the water dividing plate,
the mounting portion further comprises an upper matching portion and a lower matching portion,
the upper matching portion comprises a fixing guiding surface,
the water dividing plate comprises a first through passage,
the first through passage comprises a first inner guiding surface,
the driving mechanism comprises a push rod, a movable block, and an elastic body,
the push rod is slidably connected to the lower matching portion,
the push rod comprises a first upper guiding surface,
the movable block comprises a lower guiding surface and a third upper guiding surface,
the elastic body is connected to the driving mechanism and the mounting portion to drive the driving mechanism to be reset,
the first upper guiding surface of the push rod contacts and couples to the lower guiding surface of the movable block to enable the push rod to move to drive the movable block to move,
the third upper guiding surface of the movable block contacts and couples to the first inner guiding surface of the water dividing plate to enable the movable block to move to drive the water dividing plate to rotate in a first direction, and
the movable block cooperates with the fixing guiding surface of the upper matching portion to enable the push rod to move to drive the movable block and the water dividing plate to rotate in the first direction.

2. The waterway switching mechanism according to claim 1, wherein:
the movable block further comprises a fourth upper guiding surface,
a guiding direction of the third upper guiding surface is opposite to a guiding direction of the fourth upper guiding surface, and
the fourth upper guiding surface cooperates with the fixing guiding surface.

3. The waterway switching mechanism according to claim 1, wherein:
the push rod further comprises a second upper guiding surface, and
a guiding direction of the first upper guiding surface is opposite to a guiding direction of the second upper guiding surface.

4. The waterway switching mechanism according to claim 3, wherein:
the mounting portion further comprises a water dividing chamber,
the lower matching portion comprises a second through passage connected to the water dividing chamber, and
the push rod is slidably connected to the second through passage.

5. The waterway switching mechanism according to claim 4, wherein:
an inner wall of the second through passage comprises a guide groove extending inward,
an outer periphery of the push rod comprises a guide protrusion extending outward,
the guide protrusion couples to the guide groove to enable the push rod to be slidably connected to the second through passage,
the inner wall of the second through passage further comprises one or more first inner convex portions extending outward,
top portions of the one or more first inner convex portions comprise a second inner guiding surface,
the outer periphery of the push rod further comprises a first outer convex portion,
the first outer convex portion is disposed between two adjacent first inner convex portions of the one or more first inner convex portions, and
the first outer convex portion comprises the first upper guiding surface and the second upper guiding surface.

6. The waterway switching mechanism according to claim 2, wherein:
the movable block further comprises a body and a second outer convex portion extending outward from the body,
an upper portion of the second outer convex portion comprises a convex structure,
a top portion of the second outer convex portion comprises the third upper guiding surface and the fourth upper guiding surface, and
a bottom surface of the second outer convex portion comprises the lower guiding surface.

7. The waterway switching mechanism according to claim 6, wherein:
the upper matching portion further comprises a limiting portion, and
the second outer convex portion abuts the limiting portion to achieve positioning.

8. The waterway switching mechanism according to claim 7, wherein:
the upper matching portion further comprises a plurality of matching protrusions annularly arranged,
each of the plurality of matching protrusions comprises two side walls oppositely disposed,
a first side wall of the two side walls comprises the fixing guiding surface, and a second side wall of the two side walls comprises the limiting portion.

9. The waterway switching mechanism according to claim 1, wherein:

the push rod further comprises a rotation limiting groove, the movable block further comprises a rotation limiting protrusion, the rotation limiting protrusion cooperates with the rotation limiting groove to prevent the movable block from rotating in a second direction, and the second direction is opposite to the first direction.

10. The waterway switching mechanism according to claim 9, wherein the rotation limiting protrusion is disposed on the lower guiding surface of the movable block.

11. The waterway switching mechanism according to claim 1, further comprising:

a central shaft, wherein:

an upper end of the central shaft is fixedly connected to the upper matching portion, the push rod is slidably connected to the central shaft, the movable block is rotatably and slidably connected to the central shaft, and the elastic body surrounds the central shaft and is disposed between the upper matching portion and the movable block.

* * * * *